US008805219B2

(12) United States Patent
Shibuya

(10) Patent No.: US 8,805,219 B2
(45) Date of Patent: Aug. 12, 2014

(54) IMAGE FORMING APPARATUS USING COMMON AC VOLTAGE SOURCE FOR PLURAL CHARGING MEMBERS AND PHOTOSENSITIVE MEMBERS

(75) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/597,577

(22) Filed: Aug. 29, 2012

(65) Prior Publication Data

US 2013/0064562 A1 Mar. 14, 2013

(30) Foreign Application Priority Data

Sep. 9, 2011 (JP) ..... 2011-197708

(51) Int. Cl.
*G03G 15/02* (2006.01)
*G03G 15/00* (2006.01)

(52) U.S. Cl.
USPC ..... 399/50; 399/26

(58) Field of Classification Search
USPC ..... 399/26, 50, 168, 174–176
See application file for complete search history.

(56) References Cited

U.S. PATENT DOCUMENTS

2010/0086321 A1* 4/2010 Burry et al. ..... 399/44

FOREIGN PATENT DOCUMENTS

| | | | |
|---|---|---|---|
| JP | 63-149668 A | | 6/1988 |
| JP | 2001-201921 A | | 7/2001 |
| JP | 2008224995 A | * | 9/2008 |
| JP | 2011-075713 A | | 4/2011 |

OTHER PUBLICATIONS

European Search Report in European Patent Application No. 12183077.2, dated Mar. 28, 2014.

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming apparatus includes photosensitive drums; drum charging members, an AC voltage source for outputting an AC voltage commonly to at least two of the charging members; AC voltage control devices for the charging members; variable resistors connected between the AC voltage source and the at least two charging members, respectively; a use situation detecting unit for detecting use situations of the drums, respectively; and an adjusting unit for adjusting electric resistances of the variable resistors, respectively. The adjusting unit adjusts the electric resistances of the resistors in accordance with the detection results of the use situation detecting unit such that the discharge currents applied to the at least two charging members are within predetermined ranges, respectively.

10 Claims, 20 Drawing Sheets

IMAGE FORMING APPARATUS USING COMMON AC VOLTAGE SOURCE FOR PLURAL CHARGING MEMBERS AND PHOTOSENSITIVE MEMBERS

FIELD OF THE INVENTION AND RELATED ART

The present invention relates to an image forming apparatus such as an electrophotographic type copying machine, printer or facsimile machine.

A tandem type electrophotographic type image forming apparatus is known in which image forming stations having respective photosensitive members are arranged in line along a moving direction of a recording material carrying member or an intermediary transfer member. The image forming stations of the tandem type image forming apparatus include yellow, magenta, cyan and black image forming stations, for example, toner images formed on the photosensitive members of the image forming stations are sequentially transferred onto the recording material or an intermediary transfer member carried on the recording material carrying member, superimposedly. In each image forming station, the surface of the photosensitive member is charged uniformly, and thereafter, it is exposed to light in accordance with image information so that an electrostatic latent image is formed on the photosensitive member. The electrostatic latent image is developed with toner into a toner image on the photosensitive member.

As for charging means for charging the surface of the photosensitive member, there are non-contact charging devices such as a corotron or scorotron. As for another type charging means, there is a non-contact type or proximity type (called hereinafter simply "contact type") charging member such as a charging roller or a charging brush to which a voltage is applied, the charging roller or the charging brush being disposed in proximity with or in contact with the surface of the photosensitive member. The contact charging device is advantageous over the non-contact type charging device in that the voltage of the voltage source can be reduced and in that the generation amount of the ozone is small.

On the other hand, with the contact type charging device, the charging voltage readily changes by variation of the properties of the charging member or by change in the temperature and/or humidity. In order to suppress the readiness, an AC charging type is used in which an oscillating voltage having a DC voltage (charging DC voltage) component and an AC voltage component (charging AC voltage) is applied to the charging member.

In the AC charging type, there is a proper range in the peak-to-peak voltage of the charging AC voltage (charging AC voltage) component. If the charging AC voltage is too low, the photosensitive member is not charged up to a desired potential or the charging of the photosensitive member is not uniform with the result that sandpaper like background or foggy background (deposition of the toner on the non-image portion on which the toner is not to be deposited) is produced. If the charging AC voltage is too high, the wearing (scraping) of the photosensitive member is promoted with the result of less durability.

On the other hand, because of the existence of the minimum charging AC voltage (Vmin) necessary for uniformly charging the photosensitive member, the AC charging type charging device does not work with the charging AC voltage not higher than the minimum level. It is known that the minimum charging AC voltage is substantially twice the voltage (discharge starting voltage) at which the discharge starts between the charging member and the photosensitive member when only a DC voltage is applied to the charging member and is gradually increased (Japanese Laid-open Patent Application Sho 63-149668).

The minimum charging AC voltage changes with the property difference, among individuals, of the charging member, the photosensitive member, the voltage source circuit or the like, and with ambient condition change and elapse time. It is known that a discharge current flowing into the photosensitive member from the charging member to contribute the charging of the photosensitive member is determined, and the control is carried out to maintain the discharge current constant (discharge current control) (Japanese Laid-open Patent Application 2001-201921). A function of the flowing AC current relative to the applied charging AC voltage in the uncharging region is determined. In addition, a function of the flowing AC current relative to an applied charging AC voltage in the discharge range is determined. The discharge current is calculated as a difference between the functions to determine the required charging AC voltage or AC current thereby to control the charging bias voltage.

As described above, in the AC charging type, it is desirable to apply a charging AC voltage within the proper range.

However, in the tandem type image forming apparatus, if the image forming stations are provided with respective AC voltage sources to apply the charging AC voltages within the proper ranges to the charging members of the image forming stations, respectively, the number of the voltage sources is large. If the number of the voltage sources increases, the device is upsized, and the weight thereof increases with the result of cost increase.

Therefore, commonality of the voltage source for the image forming stations is desired. With single commonality of the voltage source, however, the same charging AC voltages are applied to the image forming stations, and therefore, when charging AC voltages within the proper ranges are different depending on the image forming stations, one or some of the image forming stations are not supplied with the proper charging AC voltages.

For example, if an optimum charging AC voltage for the yellow image forming station is 1800 Vpp-1850 Vpp, and an optimum charging AC voltage for the magenta image forming station is 2100 Vpp-2150 Vpp, and a charging AC voltage having 2000 Vpp is commonly applied to the yellow image forming station and the magenta image forming station, then, the wearing (scraping) of the photosensitive member is promoted in the yellow image forming station with the result of shortened lifetime of the photosensitive member. On the other hand, charging non-uniformity of the photosensitive member occurs in the magenta image forming station with the result of image defect such as fog.

SUMMARY OF THE INVENTION

Accordingly, it is an object of the present invention to provide an image forming apparatus in which the proper discharge currents can be provided for the respective image forming stations despite the commonality of the voltage source for applying the AC voltages to the charging members of the image forming stations.

According to an aspect of the present invention, there is provided an image forming apparatus comprising a plurality of photosensitive members; a plurality of charging members, provided for said photosensitive members, respectively, for electrically charging said photosensitive members by being supplied with charging voltages each comprising a component of an DC voltage and a component of an AC voltage; an AC voltage source for outputting an AC voltage commonly applied to at least two of said charging members; control means for controlling the AC voltages applied to said at least two charging members; variable resistors connected between said AC voltage source and said at least two charging members, respectively; use situation detecting means for detecting use situations of said photosensitive members, respectively; and adjusting means for adjusting electric resistances of said variable resistors, respectively, wherein said adjusting means adjusts the electric resistances of said variable resistors in accordance with the detection results of said use situation detecting means such that the discharge currents applied to said at least two charging members are within predetermined ranges, respectively.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

1. General Arrangement and Operation of Image Forming Apparatus

Figure 1:
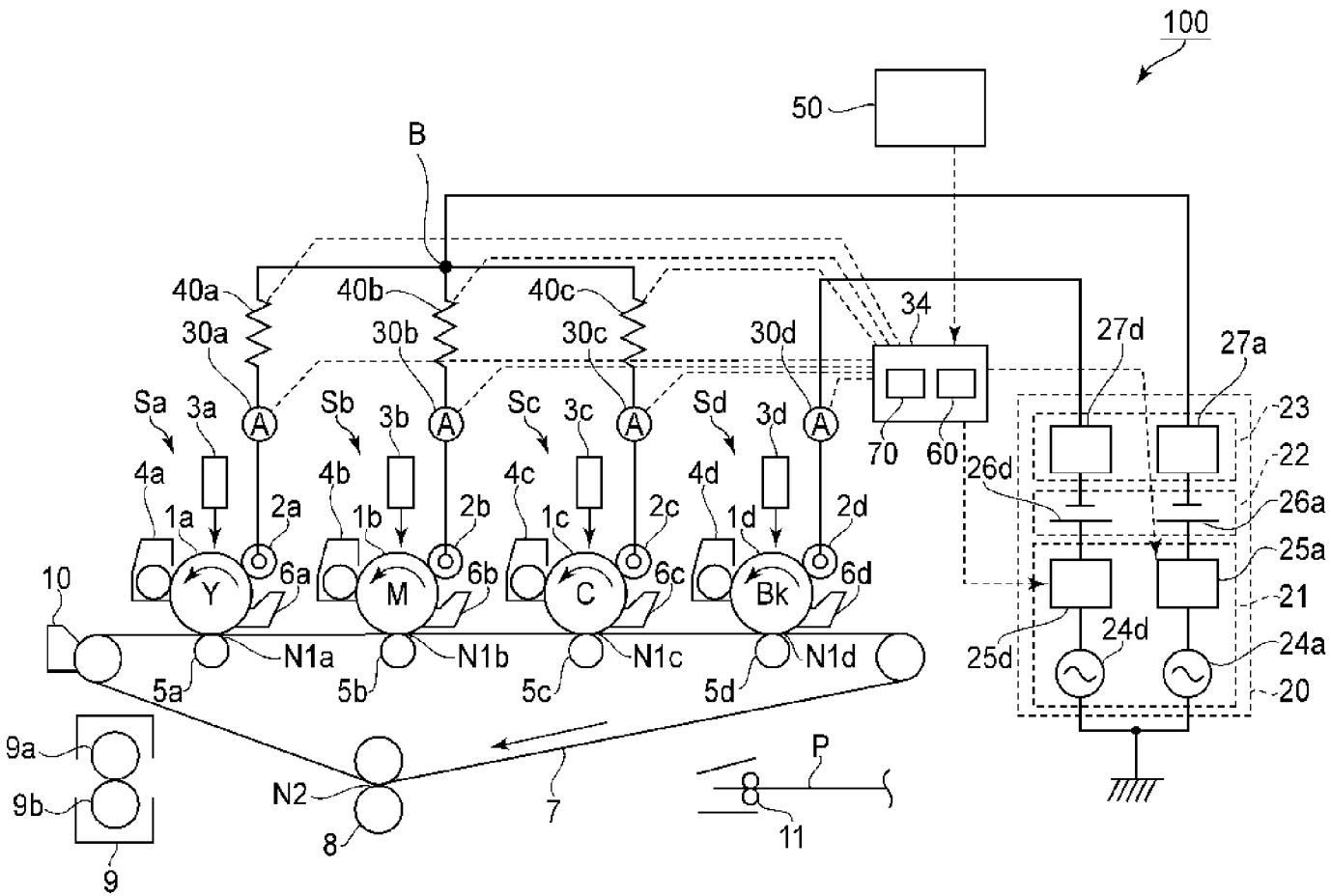
FIG. 1 is a schematic illustration of an image forming apparatus according to an embodiment of the present invention.

FIG. 1 shows a general arrangement of an image forming apparatus 100 according to Embodiment 1 of the present invention. The image forming apparatus 100 according to this embodiment is a tandem type full-color image forming apparatus using an electrophotographic system.

The image forming apparatus 100 comprises a plurality of image forming stations, namely, first, second, third and fourth image forming stations Sa, Sb, Sc, Sd for forming yellow (Y), magenta (M), cyan (C) and black (Bk) images. Such four image forming stations Sa, Sb, Sc, Sd are arranged in line at constant intervals along a moving direction of an image carrying surface of an intermediary transfer member as a transfer member which will be described hereinafter in detail. In this embodiment, a voltage source is common for the first, second and third image forming stations Sa, Sb, Sc to apply the voltages to the charging members therein.

In this embodiment, the structures and operations of the first, second, third and fourth image forming stations Sa, Sb, Sc, Sd are substantially the same except for the developers therein. Therefore, unless reference is to be made to particular ones, the suffixes a, b, c and d are omitted to indicate that reference is made to each of the elements of any of the image forming stations.

The image forming station S includes a drum type electrophotographic photosensitive member (photosensitive member), that is, photosensitive drum 1 as an image bearing member. Around the photosensitive drum 1, the following means are provided. The first one is a roller type charging member, that is, a charging roller 2 as a contact type charging means. The second is an exposure device (laser scanner) 3 as exposure means. The third is a developing device 4 as developing means. The fourth is a primary transfer roller 5 which is a roller type primary transfer member as primary transferring means. The fifth is a drum cleaning device 6 as photosensitive member cleaning means. The charging roller 2 rotates in contact with the surface of the photosensitive drum 1. The developing devices 4*a*, 4*b*, 4*c*, 4*d* accommodate yellow toner, magenta toner, cyan toner and black toner, respectively. The drum cleaning device 6 includes a cleaning blade as a cleaning member, and the cleaning blade contacts the photosensitive drum 1 to scrape the toner off the surface of the rotating photosensitive drum 1.

The apparatus further comprises an intermediary transfer belt 7 in the form of an endless belt as an intermediary transfer member which is opposed to the photosensitive drum 1 in the image forming station S. The intermediary transfer belt 7 is stretched around a plurality of rollers with a predetermined tension. The primary transfer roller 5 is opposed to the photosensitive drum 1 of the image forming station S in the inside of the intermediary transfer belt 7. The primary transfer roller 5 is urged toward the photosensitive drum 1 with the intermediary transfer belt 7 therebetween to constitute a primary transfer portion (primary transfer nip) N1 where the photosensitive drum 1 and the intermediary transfer belt 7 are contacted with each other. To the outer surface of the intermediary transfer belt 7, a secondary transfer roller 8 which is a roller type secondary transfer member as secondary transferring means is provided at a position opposed to one of the rollers supporting the intermediary transfer belt 7. The secondary transfer roller 8 is urged toward said one of the rollers with the intermediary transfer belt 7 interposed therebetween to constitute a secondary transfer portion the secondary transfer nip) N2 where said secondary transfer roller 8 and said intermediary transfer belt 7 are contacted with each other.

Image forming operations will be described with an example in which a full-color image is formed on a recording material P. First, in each image forming station S, the photosensitive drum 1 is charged uniformly by the charging roller 2. The charging voltage applying means will be described hereinafter. The surface of the charged photosensitive drum 1 is exposed to scanning light in accordance with image information by an exposure device 3. By this, an electrostatic latent image (electrostatic image) is formed on the photosensitive drum 1. The electrostatic latent image formed on the photosensitive drum 1 is developed with the toner by the developing device 4.

By this, a toner image is formed on the photosensitive drum 1. In this embodiment, the toner image is formed by the image exposure and a reverse development. That is, the photosensitive drum 1 is charged uniformly and is exposed by the exposure device 3 to decrease in the absolute value of the potential at an image portion, to which the toner charged to the polarity the same as the charge polarity of the photosensitive drum 1 (negative polarity, in this embodiment) is deposited.

The color toner images thus formed on the photosensitive drum 1 of the image forming stations S are transferred (primary transfer) sequentially and superimposedly onto the intermediary transfer belt 7 by the primary transfer rollers 5 in the primary transfer portions N1. At this time, the primary transfer roller 5 is supplied with a primary transfer voltage (primary transfer bias) of the polarity opposite to the regular charge polarity (negative in this embodiment) of the toner from a primary transfer voltage source (unshown) as a primary transfer voltage applying means. The toner images transferred onto the intermediary transfer belt are transferred (secondary transfer) onto the recording material P by the function of the secondary transfer roller 8 in the secondary transfer portion N2. At this time, the secondary transfer roller 8 is supplied with the secondary transfer voltage (secondary transfer bias voltage) of the polarity opposite to the regular charge polarity (negative in this embodiment) of the toner from a secondary transfer voltage source (unshown) as secondary transfer voltage applying means. The recording material P is fed from a recording material accommodating cassette (unshown) or the like to the secondary transfer portion N2 by a supplying roller 11 or the like. The recording material P having the transferred toner image is separated from the intermediary transfer belt 7 and is fed to a fixing device 9 as fixing means. The recording material P passes through a nip (fixing nip) between a fixing roller 9*a* and a pressing roller 9*b* of the fixing device 9, during which the toner image is heated and pressed thereby to be fixed. Thereafter, the recording material P is discharged to the outside of the image forming apparatus 100.

The toner (primary-untransferred toner) remaining on the photosensitive drum 1 after the primary transfer step is removed from the photosensitive drum 1 and is collected by the drum cleaning device 6. The residual toner (after-secondary-transfer) remaining on the intermediary transfer belt 7 after the secondary transfer step is removed and collected from the intermediary transfer belt 7 by a belt cleaning device 10 as intermediary transfer member cleaning means.

2. Charging Voltage Source Circuit or the Like

The charging rollers 2 of the image forming stations S are supplied with charging voltages (charging bias voltages) from a charging voltage source circuit 20 as charging voltage applying means. By doing so, the surfaces of the photosensitive drums 1 are charged uniformly to predetermined potentials.

The charging voltage source circuit 20 includes an AC voltage source portion 21, a DC voltage source portion 22 and a DC amplification portion 23. Using them, the charging voltage source circuit 20 generates an oscillating voltage which is in the form of superimposed DC voltage (charging DC voltage) and AC voltage (charging AC voltage), as the charging voltage to be applied to the charging rollers 2. In this embodiment, the charging voltage source circuit 20 includes respective voltage source circuit elements for the fourth image forming station Sd (black image forming station) and the color image formation portions Sa, Sb, Sc (first, second and third image forming stations). This is because, generally speaking, the frequencies of usage of the color image formation portions Sa, Sb, Sc and the black image forming station Sd are different from each other, and therefore, the deterioration speeds of a member such as the photosensitive drum 1 are, in many cases, different with the result of different required discharge current which will be described hereinafter in detail. In this embodiment, each of the DC voltage and the AC voltage are common to all of the color image formation portions Sa, Sb, Sc. For the black image forming station Sd, a different DC voltage source and a different AC voltage source are provided.

The charging rollers 2*a*, 2*b*, 2*c* of the color image formation portions Sa, Sb, Sc are supplied with the DC voltages from a first DC voltage source (DC voltage generating circuit) 26*a* in the DC voltage source portion 22. The value of the DC voltage value is adjusted by a first DC amplification circuit 27*a* in the DC amplification portion 23. The charging rollers 2*a*, 2*b*, 2*c* of the color image formation portions Sa, Sb, Sc are supplied with the AC voltage from a first AC voltage source (AC voltage generating circuit) 24*a* in the AC voltage source portion 21. The value of the AC voltage is adjusted by a first AC amplifying circuit 25*a* in the AC voltage source portion 21.

On the other hand, the charging roller 2*d* of the black image forming station Sd is supplied with the DC voltage from a second DC voltage source (DC voltage generating circuit) 26*d* in the DC voltage source portion 22. The value of the DC voltage value is adjusted by a second DC amplification circuit 27*d* in the DC amplification portion 23. The charging roller 2*d* of the black image forming station Sd is supplied with the AC voltage from the second AC voltage source (AC voltage generating circuit) 24*d* in the AC voltage source portion 21. The value of the AC voltage is adjusted by a second AC amplifying circuit 25*d* in the AC voltage source portion 21.

Charging AC currents which are the values of the AC currents flowing into the charging rollers 2*a*, 2*b*, 2*c*, 2*d* are measured by AC current measuring devices 30*a*, 30*b*, 30*c*, 30*d* as AC current measuring means, respectively. For example, a relationship between the applied charging AC voltage Vpp obtained by raising and dropping the charging AC voltage by the first and second AC amplifying circuits 25*a*, 25*b* and the measured charging AC current Iac is calculated by a control circuit 34. The relation is used in order to determine the charging AC voltage for providing the required discharge current.

In this embodiment, a frequency of an output of the AC voltage source portion 21 is 1.5 kHz. In this embodiment, the charging DC voltage is approx. −500V. In this embodiment, a charged potential of the photosensitive drum 1 converges uniformly to the charging DC voltage substantially.

The image forming apparatus 100 of this embodiment includes variable resistors 40*a*, 40*b* and 40*c* provided between the charging rollers 2*a*, 2*b*, 2*c* and a branch point of the current from the AC voltage source portion 21 to the charging rollers 2*a*, 2*b*, 2*c* of the third image forming stations Sa, Sb, Sc. The control circuit 34 controls the electric resistances of the variable resistors 40*a*, 40*b*, 40*c*. In this embodiment, the electric resistance of the variable resistor can be switched among 0Ω, 1.0×10^5Ω, 5.0×10^5Ω, 1.0×10^6Ω and 5.0×10^6Ω.

3. Structures Around Charging Roller

Figure 2:
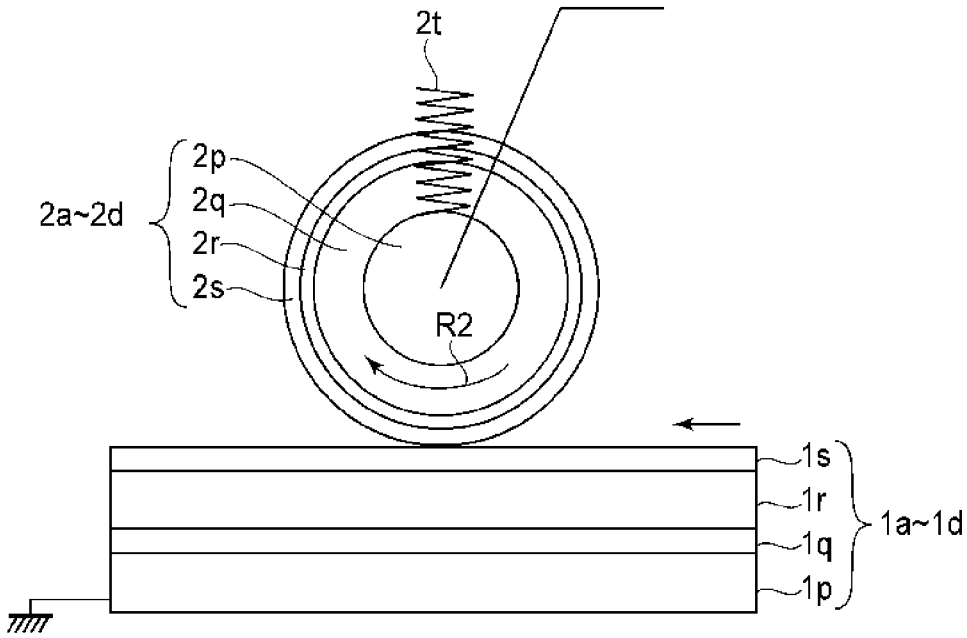
FIG. 2 is a schematic sectional view illustrating detailed structure around a charging roller of the image forming apparatus according to the embodiment of the present invention.

In this embodiment, the photosensitive drum 1 includes an organic photosensitive member (OPC) having a negative charging property and having an outer diameter of 30 mm. The photosensitive drum 1 is rotated in a direction indicated by the arrow (counterclockwise direction) in FIG. 1 at a process speed of 210 mm/s (normal speed) by a driving device (unshown). As shown in FIG. 2, the photosensitive drum 1 comprises an aluminum cylinder (electroconductive drum base member) 1*p*, and three layers therein including an undercoat layer 1*q* thereon for suppressing interference of the light and improving an adhesiveness with the upper layer, a photocharge generation layer 1*r* and a charge transfer layer 1*s*, in this order from the bottom. In this embodiment, a thickness of the charge transfer layer is 28 μm, and when it is worn down to 13 μm, a problem like improper charging arises.

In this embodiment, a length of the charging roller 2 (rotational axis direction) is 320 mm. As shown in FIG. 2, the charging roller 2 comprises a core metal (supporting member) 2*p* and three layers thereon including a lower layer 2*q*, the middle layer 2*r* and a surface layer 2*s*, in this order from the bottom. The lower layer 2*q* is a foam sponge layer effective to reduce charging noise, and the surface layer 2*s* is a protection layer for preventing current leakage which occurs if the photosensitive drum 1 has a pin hole or the like.

More specifically, the specifications of the charging roller 2 in this embodiment are as follows:

Core metal 2*p*; stainless steel round bar of diameter of 6 mm.

Lower layer 2*q*; carbon dispersed EPDM bubble generation having a density of 0.5 g/cm^3, a volume resistivity of 10^2-10^9 Ωcm and a layer thickness of 3.0 mm.

Middle layer 2*r*; carbon dispersed NBR rubber having a volume resistivity of 10^2-10^5 Ωcm and a layer thickness of 700 μm.

Surface layer 2*s*; tin oxide and carbon dispersed fluorine compound resin material having a volume resistivity of 10^7-10^10 Ωcm and a surface roughness (JIS 10 point average surface roughness Ra) of 1.5 μm and having a layer thickness of 10 μm.

The charging roller 2 is urged toward the center of the photosensitive drum 1 by an urging spring 2*t* as urging means to be press-contacted to the surface of the photosensitive drum 1 at a predetermined pressure. The charging roller 2 is rotated by the photosensitive drum 1. A press-contact portion between the photosensitive drum 1 and the charging roller 2 is a charging nip. In this embodiment, an overall volume resistivity of the charging roller 2 is 1.0×10^5 Ωcm.

Here, in a contact type charging device, the charging member is not necessarily contacted to the surface of the photosensitive member. If only the dischargeable region determined by a voltage across the gap and a corrected Paschen curve is assured between the charging member and the photosensitive member, they may be spaced by several 10 μm, for example (non-contact proximity arrangement). Therefore, in this invention, the contact charging includes such proximity charging.

4. Operational Sequence of Image Forming Apparatus

Figure 3:
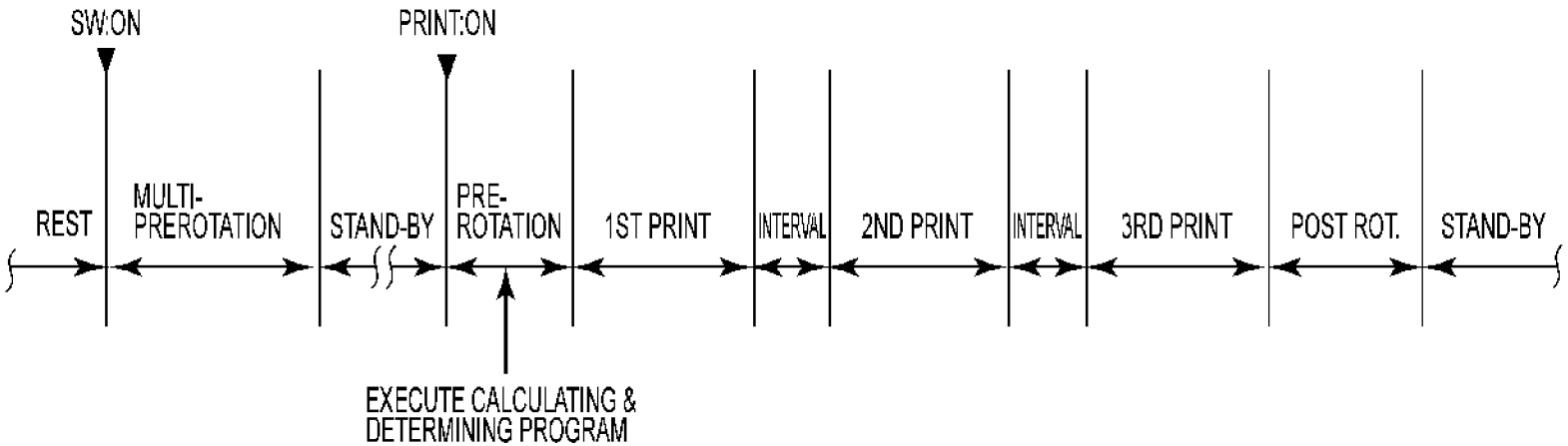
FIG. 3 is an operation sequence diagram of the image forming apparatus according to the embodiment of the present invention.

FIG. 3 shows an operational sequence of the image forming apparatus 100 in this embodiment.

a. Initial Rotating Operation (Multiple Pre-Rotation Step):

An initial rotating operation is carried out during a starting operation period (starting operation period or warming period) at the time of starting the image forming apparatus 100. In the initial rotating operation, upon actuation of a main switch of the image forming apparatus 100, the photosensitive drum 1 is rotated, the fixing device 9 is heated to a predetermined temperature, and other predetermined preparing operations for the process means are executed.

b. Rotating Operation for Printing Preparation (Pre-Rotation Step):

The rotating operation for the printing preparation is carried out after the input of a printing signal (image formation start signal) before the printing step (image forming process) is actually executed (preparation rotating operation period). The rotating operation for the printing preparation is carried out continuing from the initial rotating operation, when the printing signal is inputted during the initial rotating operation. When the printing signal is not inputted, the main motor is once stopped after completion of the initial rotating operation so that the rotation of the photosensitive drum 1 is stopped, and the image forming apparatus 100 is placed in a stand-by (waiting) state until the printing signal is inputted. When the printing signal is inputted, the rotating operation for the printing preparation is carried out.

In this embodiment, during the rotating operation for the printing preparation, a calculation and determination program for the appropriate charging AC voltage for the charging step is executed. This will be described in detail hereinafter.

c. Printing Step (Image Forming Process, Image Forming Step):

When the predetermined rotating operation for the printing preparation is completed, the image formation process is carried out on the continuously rotating photosensitive drum 1, and the toner image formed on the surface of the rotating photosensitive drum is transferred to the recording material P, and the toner image is fixed by the fixing device 9. Then, a print is discharged (print-out) to the outside of the image forming apparatus 100.

In the case of continuous printing, the printing step is carried out repetitively for the set number of image formations.

d. Operation Between Sheets Processed (Sheet Interval Step):

This operation is carried out, in the case of the continuous printing operation, during the period after a trailing end of a recording material P passes through the transfer position (secondary transfer portion N2) and before a leading end of the next recording material P reaches the transfer position, that is, the recording material P is not present in the transfer position.

e. Post-Rotating Operation:

The post-rotating operation is carried out after completion of the printing step on a single recording material P or after completion of the printing step on the final recording material P in the continuous printing. During the post-rotating operation, that is, the main motor continues to drive to rotate while carrying out predetermined finishing operations (preparing operation for the next image forming operation) in such periods.

f. Stand-by:

When the predetermined post-rotating operation is completed, the main motor is stopped to stop the rotation of the photosensitive drum 1, and the image forming apparatus 100 is placed in the stand-by state until the next printing signal is inputted. In the case of a single print operation, after completion of the print, the post-rotating operation is carried out, and the image forming apparatus 100 is placed in the stand-by state. In the stand-by state, when the printing signal is inputted, the image forming apparatus 100 carries out the pre-rotation step.

The printing step period in above section c is the image forming operation period, and the initial rotating operation period in above section a, the pre-rotating operation period in above section b, the sheet interval step period in the above section d and the post-rotating operation period are non-image-formation periods.

5. Controlling Manner:

The operation of the image forming apparatus 100 in this embodiment is controlled as a whole by the control circuit 34 provided in the image forming apparatus 100. As shown in FIG. 1, the control circuit 34 comprises a memory 60 as storing means for storing information, and a CPU 70 as control means for instructing various operations of the image forming apparatus 100.

In this embodiment, the image forming apparatus 100 includes a counter 50 as use situation detecting means for detecting use situation information of the photosensitive drum 1 of each of the image forming stations. The use situation information detected by the counter 50 is transmitted to the control circuit 34. In this embodiment, the number of image formations which are interrelated with a use amount of the photosensitive drum 1 is detected as the use situation information. In this embodiment, the counter 50 counts the print number while converting to the number of A4 size recording materials P oriented in the predetermined direction, and cumulates the counts.

To the control circuit 34, the use situation information is transmitted from the counter 50, and the information of the AC current flowing between the photosensitive drum 1 and the charging roller 2 from the current measuring device 30 is transmitted. The information is stored in the memory 60 if necessary. The CPU 70 controls various operations of the image forming apparatus 100 in accordance with the information stored in the memory 60.

6. Discharge Current:

A method of controlling the charging AC voltage applied to the charging roller 2 during the printing step will be described.

Figure 4:
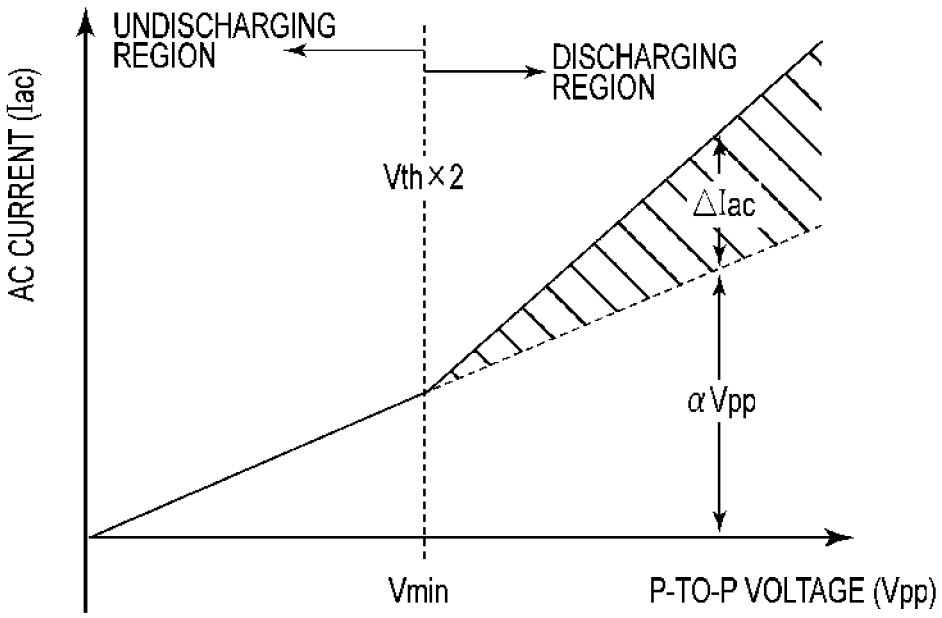
FIG. 4 is an illustration of a control method for a charging AC voltage of the image forming apparatus according to the embodiment of the present invention.

As shown in FIG. 4, the charging AC current Iac which is a value of the AC current flowing by the application of the charging AC voltage has the following relationship relative to the charging AC voltage Vpp which is a value of the peak-to-peak voltage of the charging AC voltage. That is, the relationship is linear by the un-discharging range in which the voltage is less than twice the discharge starting voltage (Vthx2: discharge start point). Here, the discharge starting voltage Vth is the voltage at which the discharge to the photosensitive member starts when a DC voltage is applied to the charging member. In the discharge range not less than Vthx2, the charging AC current Iac gradually offsets toward an increasing side with increase of the charging AC voltage Vpp. In similar experiments in vacuum in which no discharge occurs, the linearity is maintained, and therefore, the offset is the increment ΔIac of the current contributing to the discharge.

As described above, in the AC charging type, there is a required minimum charging AC voltage (Vmin). It is known that the minimum charging AC voltage is substantially twice the discharge starting voltage Vth. If the charging AC voltage is not more than the minimum level, the charging of the photosensitive drum 1 is non-uniform with the result of the image defect such as the foggy background, sandpaper like background or the like. The minimum charging AC voltage changes depending on the variation of the electric resistance of the charging member or depending on the changes thereof with elapse of time, for example. Therefore, with the known AC charging type, the charging AC voltage is not less than the minimum charging AC voltage normally. For the similar reasons, the charging AC voltage is such that a charging AC current is not less than the charging AC current which flows when the minimum charging AC voltage is applied.

Here, a ratio of the charging AC current relative to the charging AC voltage Vpp in the un-discharging range less than Vthx2 is α. Then, the AC current which is the current flowing to the contact portion between the charging member and the photosensitive member (nip current) except for the discharge current at discharge range not less than Vthx2 is α·Vpp. Therefore, the following ΔIac which is a difference between the charging AC voltage Iac measured in the discharge range not less than Vthx2 and α·Vpp is defined as a discharge current representing the discharge amount provided by the application of the charging AC voltage:

$$\Delta Iac = Iac - \alpha \cdot Vpp \quad (1)$$

With increase of the discharge current ΔIac, the wearing (scraping) or the image flow of the photosensitive member is promoted. The image flow is a phenomenon in which the electric discharge product or the like, ozone and/or NOx are deposited on the surface of the photosensitive member, and the deposited matter absorbs moisture under a high humidity ambience with the result of reduction of the charge retention performance of the surface of the photosensitive member, which leads to the disturbance to the image When the discharge current ΔIac decreases, the image defect such as the foggy background and the sandpaper like background is produced. Therefore, in the AC charging type system, the settings are controlled such that the minimum discharge current capable of charging the photosensitive member uniformly is provided. By doing so, satisfactory images can be formed, and the scraping of the photosensitive member is minimized, thus elongating the lifetime of the image forming apparatus.

7. Control of the Charging AC Voltage in Color Image Formation Portion

The control of the charging AC voltage supplied from the common AC voltage source and applied to the charging rollers 2*a*, 2*b*, 2*c* of the color image formation portions Sa, Sb, Sc will be described.

Figure 5:
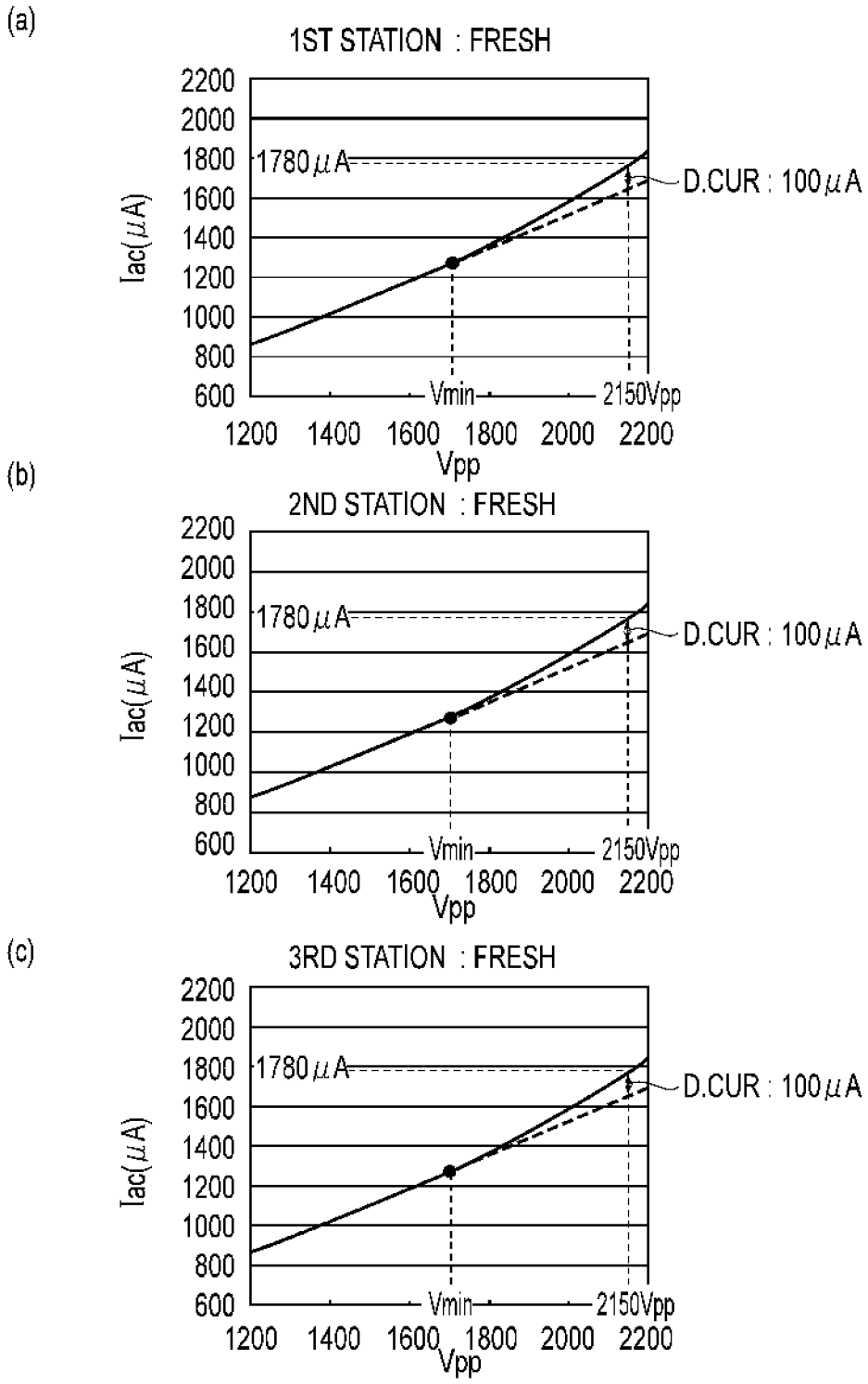
FIG. 5 is a graph of an example of Vpp-Iac in a color image formation portion when a fresh photosensitive drum is used in the image forming apparatus according to the embodiment of the present invention.

Parts (a), (b) and (c) of FIG. 5 show an example of a relation (Vpp-Iac) of the charging AC current Iac relative to the charging AC voltage Vpp in the first, second and third image forming stations Sa, Sb, Sc, respectively, when the photosensitive drum 1 is a fresh one. When the photosensitive drum 1 is fresh, an inclination of the graph of the Vpp-Iac is substantially the same, and the charging AC voltage Vpp required to provide the necessary discharge current is also the same. In this embodiment, the optimum discharge current (required minimum charging AC voltage (Vmin)) with which the uniform charging of the photosensitive drum 1 is assured, and the wearing of the photosensitive drum 1 is suppressed is 100±20 μA. When the photosensitive drum 1 is fresh, the charging AC voltage at the time of the discharge current being 100 μA is 2150 Vpp equally in the first, second and third image forming stations Sa, Sb, Sc. In the fresh state of the photosensitive drum 1, there is hardly any difference among the film thicknesses of the photosensitive drums 1 of the first, second and third image forming stations Sa, Sb, Sc. Therefore, in such a state, by applying in parallel the same charging AC voltage to the charging rollers 2 of the first, second and third image forming stations Sa, Sb, Sc from the single voltage source, the discharge currents are 100 μA in all these image forming stations.

However, with wearing of the photosensitive drums 1 with increase of the use amount, the electric capacity of the photosensitive drum 1 increases, with the result that the electric field across the space between the photosensitive drum 1 and the charging roller 2 increases, and therefore, the discharge readily occurs.

Figure 6:
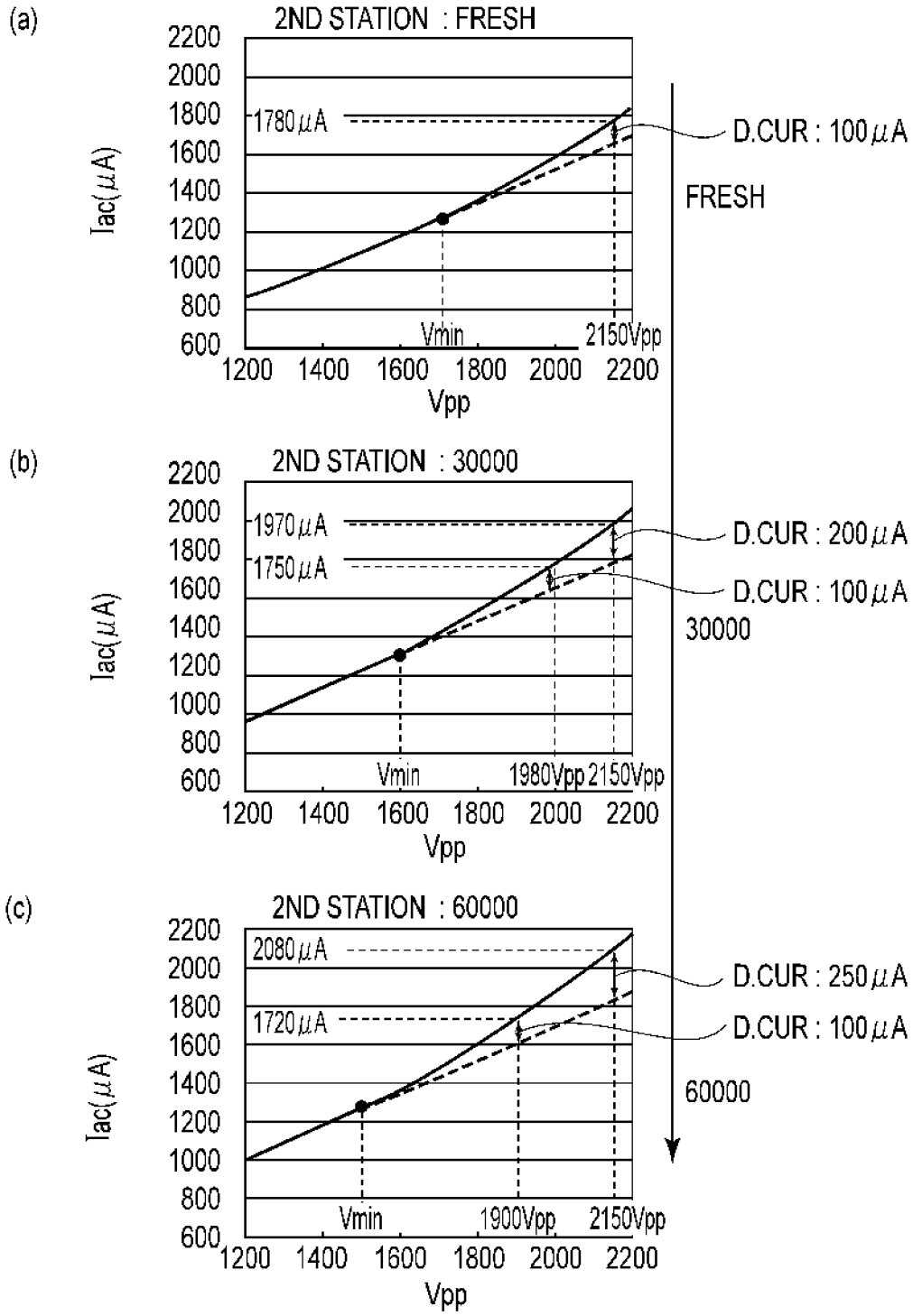
FIG. 6 is a graph of an example of the Vpp-Iac of the color image formation portion with increase of the number of image formations in the image forming apparatus according to the embodiment of the present invention.

Parts (a), (b) and (c) of FIG. 6 show the change of the Vpp-Iac in the process wearing of the photosensitive drum 1, taking the second image forming station Sb for instance. This Figure shows the results of measurements under the ambient condition of the temperature of 23° C. and 5% of humidity. Part (a) of FIG. 6 corresponds to part (b) of FIG. 5.

In the case of fresh photosensitive drum 1, it will suffice if the charging AC voltage 2150 Vpp is applied (part (a) of FIG. 6) in order to control the discharge current at the 100 μA. However, when the use amount of the photosensitive drum 1 is 30000 sheets (in terms of A4 sheets), the charge transfer layer of the photosensitive drum 1 is thinned by the wearing. Therefore, the electric capacity of the photosensitive drum 1 is large with the result of readiness of the discharge between the photosensitive drum 1 and the charging roller 2. Therefore, the value of the required minimum charging AC voltage (Vmin) (approximately twice the discharge starting voltage Vth) is small, and the inclination of the graph of the Vpp-Iac is large (part (b) of FIG. 6). When the number of image formations is 60000, the wearing amount of the photosensitive drum 1 is further large, the required minimum charging AC voltage (Vmin) is further small, and the inclination of the Vpp-Iac is further large (part (c) of FIG. 6).

If, under such a condition, the charging AC voltage is kept set at 2150 Vpp, which is the same as with the fresh photosensitive drum 1, the discharge current is 200 μA when the number of image formations is 30000, and it is 250 μA when the number of image formations is 60000, that is, the discharge is slightly more than the proper level.

Therefore, the wearing amount of the photosensitive drum 1 further increases, and the toner and/or the externally added material may be deposited on the surface of the photosensitive drum 1 (filming).

It is desirable that with the increase of the number of image formations, the charging AC voltage is decreased. In order to provide the discharge current of 100 μA in this embodiment, the charging AC voltage is reduced to 1980 Vpp for 30000 sheets and to 1900 Vpp for 60000 sheets, for example, as shown in FIG. 6. By this, the above-described problems attributable to the excessive discharge can be suppressed.

Table 1 shows a relation between the number of image formations and the optimum charging AC voltage to provide the discharge current of 100 μA. The optimum charging AC voltage changes for each 15000 of the number of image formations. Therefore, in this embodiment, the charging AC voltage is lowered accompanying the increase of the number of image formations, in accordance with Table 1.

TABLE 1

| Cumulative number of image formations (sheet) | Optimum applied voltage Vpp when discharging current is 100 μmA |
|---|---|
| 0 | 2150 |
| 15000 | 2040 |
| 30000 | 1980 |
| 45000 | 1930 |
| 60000 | 1900 |

However, when the charging AC voltage is applied to the charging rollers 2 of the image forming stations from the single AC voltage source as in this embodiment, the following problem arises.

If the cumulative numbers of image formations on the photosensitive drums 1*a*, 1*b*, 1*c* of the first, second and third image forming stations Sa, Sb, Sc are the same, for example, the problem of the excessive discharge does not arise by changing the charging AC voltages for all of the image forming stations in accordance with Table1. Or, if the photosensitive drums 1*a*, 1*b*, 1*c* of the first, second and third image forming stations Sa, Sb, Sc are replaced simultaneously, the problem of the excessive discharge does not arise.

However, the use situations of the first, second and third image forming stations Sa, Sb, Sc are different actually. The numbers of image formations may be different among the first, second and third image forming stations Sa, Sb, Sc, when the images are formed using one of the first, second and third image forming stations Sa, Sb, Sc, for example. If the photosensitive drums 1 of the first, second and third image forming stations Sa, Sb, Sc have to be simultaneously replaced, all the photosensitive drums 1 have to be replaced even if a problem arises in only one image forming station. From the standpoint of low running cost, the photosensitive drums 1 are replaceable independently from each other in the recent image forming apparatus in most cases.

Therefore, in the image forming apparatus 100 of this embodiment, when the number of image formations in an image forming station reaches 60000, a message promoting the replacement of the particular photosensitive drum 1 is indicated on an operating portion (unshown) of the image forming apparatus 100.

Therefore, when the photosensitive drums 1 of the first, second and third image forming stations Sa, Sb, Sc are not replaced simultaneously, or when the number of image formations of any of the photosensitive drums 1 of the first, second and third image forming stations Sa, Sb, Sc is large, the following results. With the structure in which the charging AC voltages are applied in parallel by a single AC voltage source, the difference of the discharge current among the image forming stations may be large.

Figure 7:
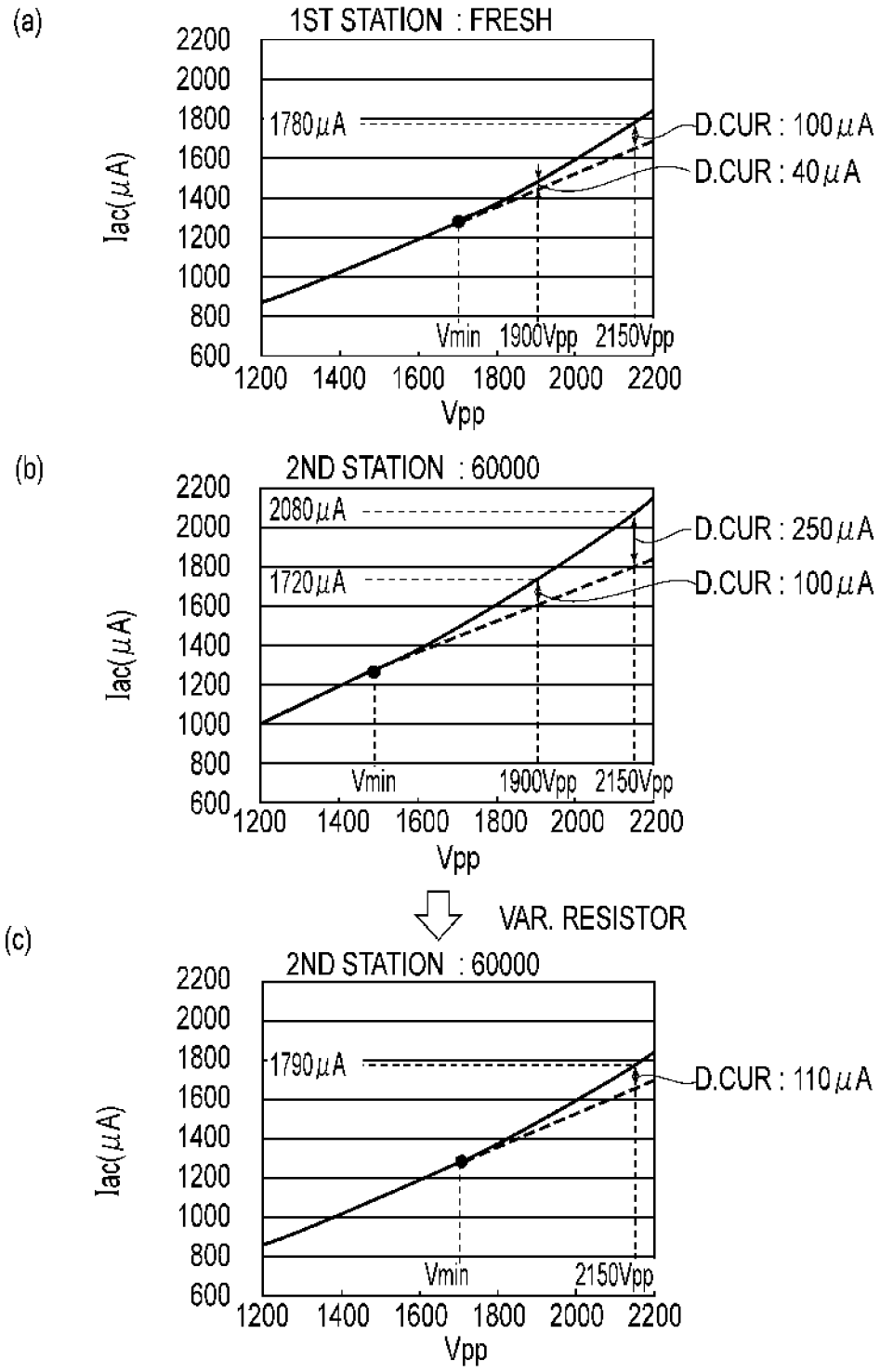
FIG. 7 is a graph of an example of Vpp-Iac illustrating a principle of a control for the charging AC voltage in the image forming apparatus according to the embodiment of the present invention.

Parts (a), (b) and (c) of FIG. 7 show an example of the Vpp-Iac when the difference among the discharge currents of the first, second and third image forming stations Sa, Sb, Sc is large. Part (a) of FIG. 7 is a graph when the photosensitive drum 1*a* of the first image forming station Sa is fresh, and part (b) of FIG. 7 is a graph of the Vpp-Iac when the number of image formations of the second image forming station Sb is 60000, which means close to the end of the lifetime thereof.

With respect to the example of FIG. 7, when the charging AC voltage is controlled so that the discharge current by the first image forming station Sa is 100 μA, the charging AC voltage of 2150 Vpp is applied to the first image forming station Sa. Then, the same 2150 Vpp is applied to the second image forming station Sb, too, if the charging AC voltage is applied in parallel by a single AC voltage source. In this case, the discharge current is 250 μA in the second image forming station Sb, which means slightly excessive discharge.

On the other hand, the charging AC voltage is controlled so that the discharge current by the second image forming station Sb is 100 μA, the charging AC voltage of 1900 Vpp is applied to the second image forming station Sb. And, the same 1900 Vpp is applied to the first image forming station Sa, too. In this case, the discharge current in the first image forming station Sa is 40 μA, which means shortage of the discharge current with the result of the image defect attributable to the improper charging of the photosensitive drum 1, such as the sandpaper like background and/or foggy background.

Figure 8:
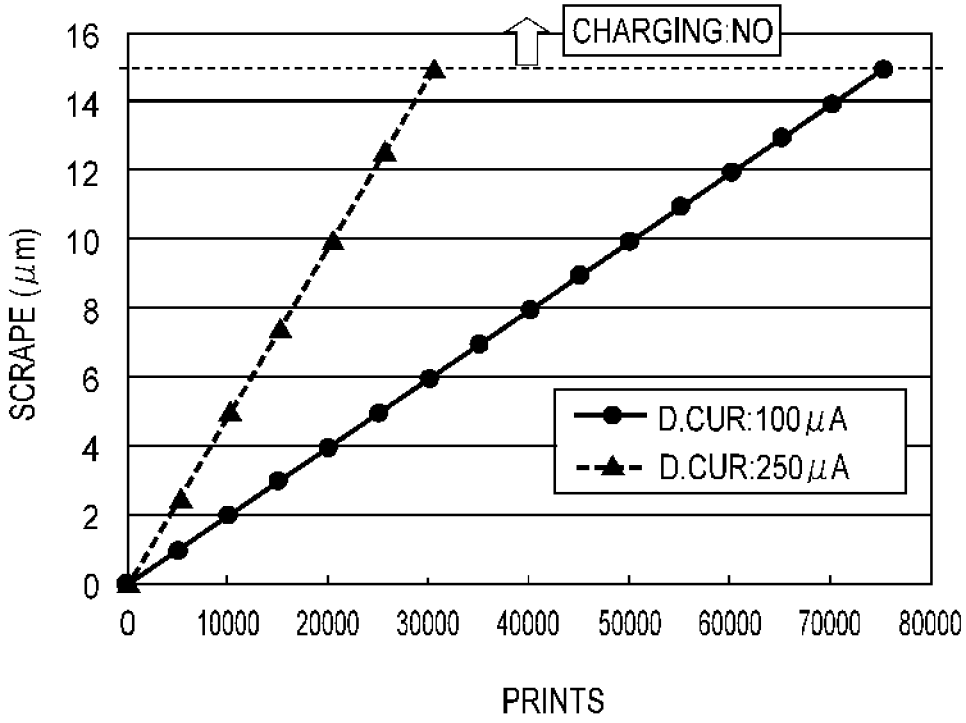
FIG. 8 is a graph of a relationship between a discharge current and a scraping amount of the photosensitive drum in an image forming apparatus according to an embodiment of the present invention.

FIG. 8 is a graph showing an interrelation between the number of image formations and the scraping amount of the photosensitive drum 1 when the discharge current is 100 μA (proper discharge current in this embodiment) and when the discharge current is 250 μA.

The scraping amount of the photosensitive drum 1 is the scraping amount of the charge transfer layer of the photosensitive drum 1. In this embodiment, as described above, the charging property is poor with the result of improper charging, when the scraping amount of the photosensitive drum 1 is not less than 15 μm.

In the example of FIG. 8, when the discharge current is 100 μA (proper discharge current in this embodiment), the scraping amount the photosensitive drum 1 reaches 15 μm at the time of 75000 of the number of image formations. Therefore, in this embodiment, when the number of image formations reaches 75000, it is deemed that the lifetime of the photosensitive drum 1 ends. However, when the discharge current is 250 μA, the scraping amount of the photosensitive drum 1 becomes 15 μm at the time of 30000 of the number of image formations, that is, the lifetime of the photosensitive drum 1 is shortened.

As described in the foregoing, with the structure in which the charging AC voltages are applied in parallel to the charging members of the image forming stations by the single AC voltage source, the excessive discharge and improper charging may occur in one or some of the image forming stations.

Under the circumstances, in this embodiment, the variable resistors 40*a*, 40*b*, 40*c* are adjusted in accordance with the use situation of the photosensitive drum 1, more particularly in accordance with the number of image formations which interrelates with the use amount of the photosensitive drum 1.

In this embodiment, the use is made with a rotatable potentiometer in combination with a gear to adjust the electric resistances of the variable resistors. By rotating the gear in accordance with the input of the CPU 70 of the control circuit 34, the variable resistors 40*a*, 40*b* and 40*c* are set to predetermined electric resistances.

The description will be made with respect to the example of FIG. 7. As shown in part (a) of FIG. 7, in the case that the photosensitive drum 1*a* of the first image forming station Sa is fresh, the variable resistor 40*a* is set to 0Ω. As shown in part (b) of FIG. 7, when the number of image formations of the second image forming station Sb is 60000, the electric capacity of the photosensitive drum 1*b* is large, so that the discharge readily occurs between the photosensitive drum 1*b* and the charging roller 2*b*. Therefore, in such a case, the variable resistor 40*b* is set to 5.0×10^6Ω. The charging AC voltage is 2150 Vpp which is suitable for a fresh photosensitive drum 1*a* of the first image forming station Sa. Part (c) of FIG. 7 shows Vpp-Iac in the second image forming station Sb in such a case. From part (c) of FIG. 7, the inclination in the graph of the Vpp-Iac in the second image forming station Sb at this time is substantially the same as the inclination in the graph (part (a) of FIG. 7) of the Vpp-Iac in the first image forming station Sa when the photosensitive drum 1 is fresh. The discharge current when the charging AC voltage of the 2150 Vpp is applied is 110 μA which is within the optimum range of the discharge current in this embodiment.

In this embodiment, the electric resistance of the variable resistor 40 is adjusted as follows. When the number of image formations is 0 (fresh)-5000, the resistance is 0Ω; when it is 5000-15000, the resistance is 1.0×10^5Ω; when it is 15000-30000, the resistance is 5.0×10^5Ω; when it is 30000-45000, the resistance is 1.0×10^6Ω; and when it is 45000-60000, the resistance is 5.0×10^6 Ω. The charging AC voltage is set to 2150 Vpp required when photosensitive drum 1 is fresh, by which the discharge current can be controlled within the range of 100 μA±20 μA for all of the first-third image forming stations Sa-Sc, irrespective of the use situation of the photosensitive drum 1.

Figure 9:
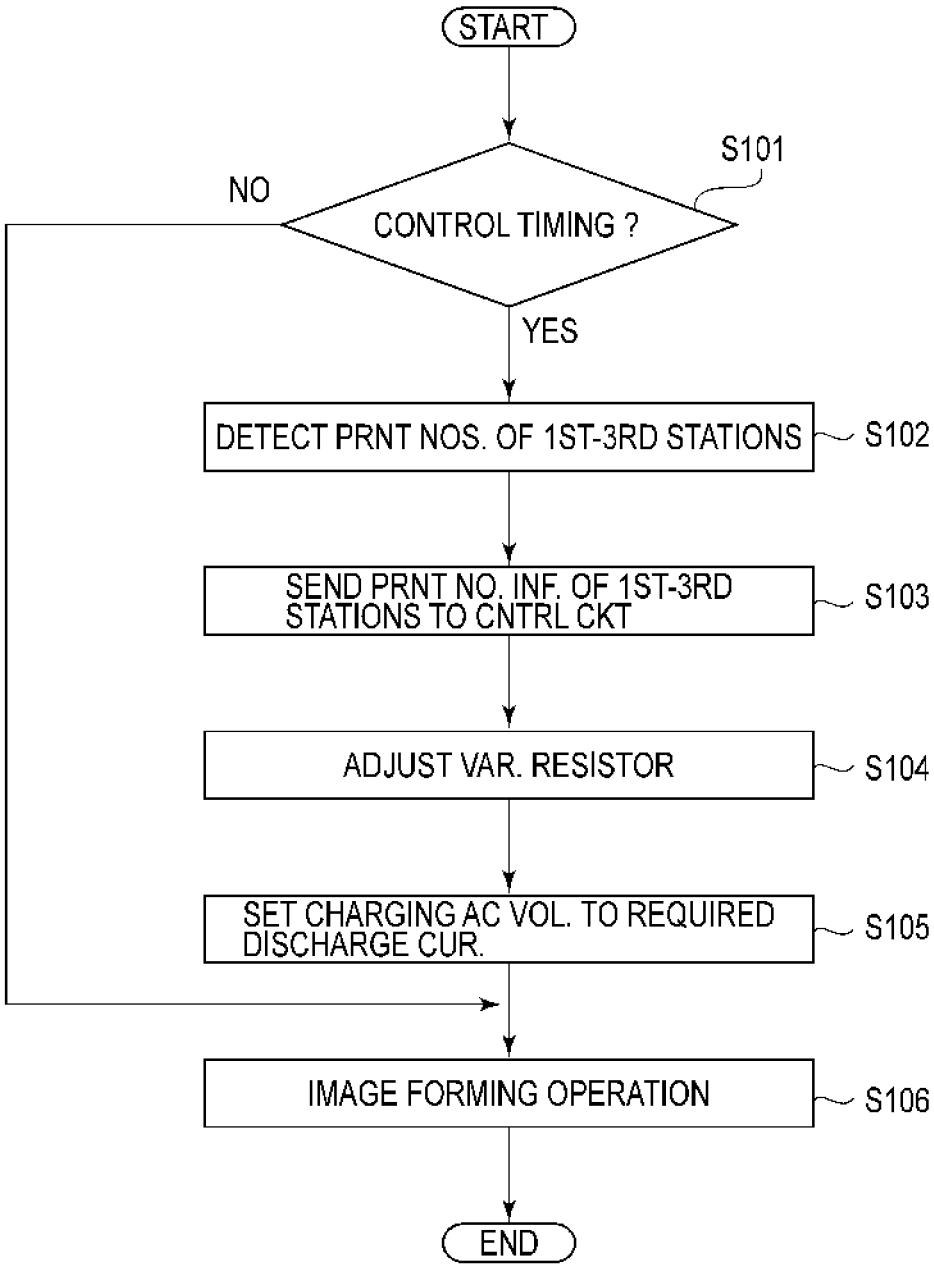
FIG. 9 is a flow chart showing a process of the control method for the charging AC voltage in the image forming apparatus according to the embodiment of the present invention.

FIG. 9 is a flowchart illustrating the control of adjusting the charging AC voltage applied to the charging rollers 2*a*, 2*b*, 2*c* of the color image formation portions Sa, Sb, Sc in which the AC voltage source is common in this embodiment.

The CPU 70 starts the process at the timing of the charging bias voltage control (at the printing preparation rotating operation in this embodiment) (S101). First, the counter 50 detects the number of image formations of the photosensitive drums 1*a*, 1*b*, 1*c* of the first, second and third image forming stations Sa, Sb, Sc (S102). The information indicative of the number of image formations of the photosensitive drums 1*a*, 1*b*, 1*c* is transmitted to the memory 60. The CPU 70 adjusts the variable resistors 40*a*, 40*b*, 40*c* in response to the information of the use amounts of the photosensitive drums 1*a*, 1*b*, 1*c* stored in the memory 60 as described above. After the adjustment of the variable resistors 40*a*, 40*b*, 40*c*, the CPU 70 determines (S105) the charging AC voltage required to provide the discharge current necessary for a fresh photosensitive drum 1 (number of image formations=0), as the charging AC voltage to be applied during the printing step. In this embodiment, it is 2150 Vpp for the discharge current of 100 μA. The charging AC voltage of the charging voltage is constant-voltage-controlled during the image forming operation (S106).

If, in S101, the result of the discrimination indicates that it is not the timing of the charging bias voltage control, the processes S102-S105 are not carried out, and the image forming operation is executed with the previous setting of the charging AC voltage (S106).

As will be understood from the foregoing, in this embodiment, the image forming apparatus 100 includes an AC voltage source 21 for outputting the AC voltage to be applied commonly to at least two charging members. The image forming apparatus 100 includes control means for controlling the AC voltage to be applied to at least two charging members from the AC voltage source. The image forming apparatus 100 includes variable resistors 40 connected between the AC voltage source 21 and the at least two charging members, respectively. The image forming apparatus 100 includes use situation detecting means (counter) 50 for detecting the use situation of each of the photosensitive members. The image forming apparatus 100 includes adjusting means for adjusting the electric resistances of the variable resistors 40, respectively. In this embodiment, the CPU 70 has functions of the control means and the adjusting means. In this embodiment, the control means applies, from the AC voltage source 21 to the at least two charging members, the AC voltage set such that the predetermined discharge current is provided when the use situation of the photosensitive member is the predetermined one upon the image formation. The adjusting means adjusts the electric resistance of the variable resistors 40 connected to the at least two charging members, respectively, in image formation, in the following manner. That is, the adjustment is effected in accordance with the detection result, by the use situation detecting means 50, of the use situations of the photosensitive members charged by the at least two charging members, so that the discharge currents within the predetermined range are provided between the at least two charging members and the associated photosensitive members, respectively. In this embodiment, the specified use situation is the fresh state of the photosensitive member. Particularly, in this embodiment, the use situation of the photosensitive member is discriminated on the basis of the cumulated image formation number using the photosensitive member, and the image forming apparatus 100 is provided with counting means (counter) for counting the number of image formations as the use situation detecting means.

In this embodiment, the AC current measuring device 30 is provided in the image forming apparatus 100, but the AC current measuring device 30 may be omitted with the implementation of the control for the charging AC voltage of this embodiment.

As described in the foregoing, according to this embodiment, the charging AC voltages are outputted to the plurality of image forming stations from the single AC voltage source, so that an inexpensive and small size structure can be accomplished. With such a structure, the variable resistors 40 provided between the AC voltage source and the charging rollers 2 of the image forming stations are adjusted in accordance with the number of image formations of the image forming stations. By this, even if there is a difference in the wearing amount between the photosensitive drums 1 of the image forming stations, the discharge current in the optimum range can be provided with the same charging AC voltage. Therefore, the low cost, and the downsizing of the device can be accomplished, while maintaining high image quality for long term. Thus, according to this embodiment, a voltage source is used commonly for a plurality of image forming stations, and the proper discharge current can be provided in each image forming station.

Embodiment 2

Another embodiment will be described. The fundamental structures and operations of the image forming apparatus of this embodiment are the same as those of Embodiment 1. In the description of this embodiment, the same reference numerals as in Embodiment 1 are assigned to the elements having the corresponding functions in this embodiment, and the detailed description thereof is omitted for simplicity.

In Embodiment 1, the use situation of the photosensitive drum 1 is represented by the cumulated number of image formations, on the basis of which the electric resistance of the variable resistor 40 is adjusted. As shown in FIG. 3 of the operational sequence of the image forming apparatus 100, the image forming operation includes the multiple pre-rotation period, the sheet interval period and the post-rotation step. Therefore, the scraping amount of the photosensitive drum 1 may be different between when the image formations are carried out continuously on 100 sheets and when they are carried out on 100 sheets non-continuously.

In view of this, in this embodiment, the counter 50 as the use situation detecting means detects the number of rotations of the photosensitive drum 1 which is interrelated with the use amount of the photosensitive drum 1. In this embodiment, the counter 50 counts the number of rotations of the photosensitive drum 1 of each image forming station by the drive time (durations) of the driving motor. More particularly, the counter 50 obtains the number of rotations of the photosensitive drum 1 from the drive time and the rotational speed of the photosensitive drum 1, and the number of rotations is integrated and stored.

Table 2 shows a relationship between the number of rotations of the photosensitive drum and the optimum charging AC voltage to provide the discharge current of 100 μA in this embodiment. The optimum charging AC voltage changes for each 40000 rotations of the photosensitive drum 1. Therefore, in this embodiment, it is desired to lower the charging AC voltage with increase of the cumulated number of rotations of the photosensitive drum 1 in accordance with Table 2.

TABLE 2

| Cumulative number of rotations of photosensitive drum | Optimum applied voltage Vpp when discharging current is 100 μmA |
|---|---|
| 0 | 2150 |
| 40000 | 2040 |
| 80000 | 1980 |
| 120000 | 1930 |
| 160000 | 1900 |

However, when the charging AC voltage is applied to the charging rollers 2 of the image forming stations from the single AC voltage source as in this embodiment, the following problem arises.

If the numbers of rotations of the photosensitive drums 1*a*, 1*b*, 1*c* of the first, second and third image forming stations Sa, Sb, Sc are the same, for example, the problem of the excessive discharge does not arise by changing the charging AC voltages for all of the image forming stations in accordance with Table1. Or, if the photosensitive drums 1*a*, 1*b*, 1*c* of the first, second and third image forming stations Sa, Sb, Sc are replaced simultaneously, the problem of the excessive discharge does not arise.

However, the use situations of the first, second and third image forming stations Sa, Sb, Sc are different actually. The numbers of rotations of the photosensitive drums 1 may be different among the first, second and third image forming stations Sa, Sb, Sc, when the images are formed using one of the first, second and third image forming stations Sa, Sb, Sc, for example. If the photosensitive drums 1 of the first, second and third image forming stations Sa, Sb, Sc have to be simultaneously replaced, all the photosensitive drums 1 have to be replaced even if a problem arises in only one image forming station. From the standpoint of low running cost, the photosensitive drums 1 are replaceable independently from each other in the recent image forming apparatus in most cases.

Therefore, in the image forming apparatus 100 of this embodiment, when the number of rotations of the photosensitive drum 1 in an image forming station reaches 160000, a message promoting the replacement of the particular photosensitive drum 1 is indicated on an operating portion (unshown) of the image forming apparatus 100.

Therefore, when the photosensitive drums 1 of the first, second and third image forming stations Sa, Sb, Sc are not replaced simultaneously, or when the number of rotations of the photosensitive drum 1 of any of the photosensitive drums 1 of the first, second and third image forming stations Sa, Sb, Sc is large, the following results. With the structure in which the charging AC voltages are applied in parallel by a single AC voltage source, the difference of the discharge current among the image forming stations may be large.

Figure 10:
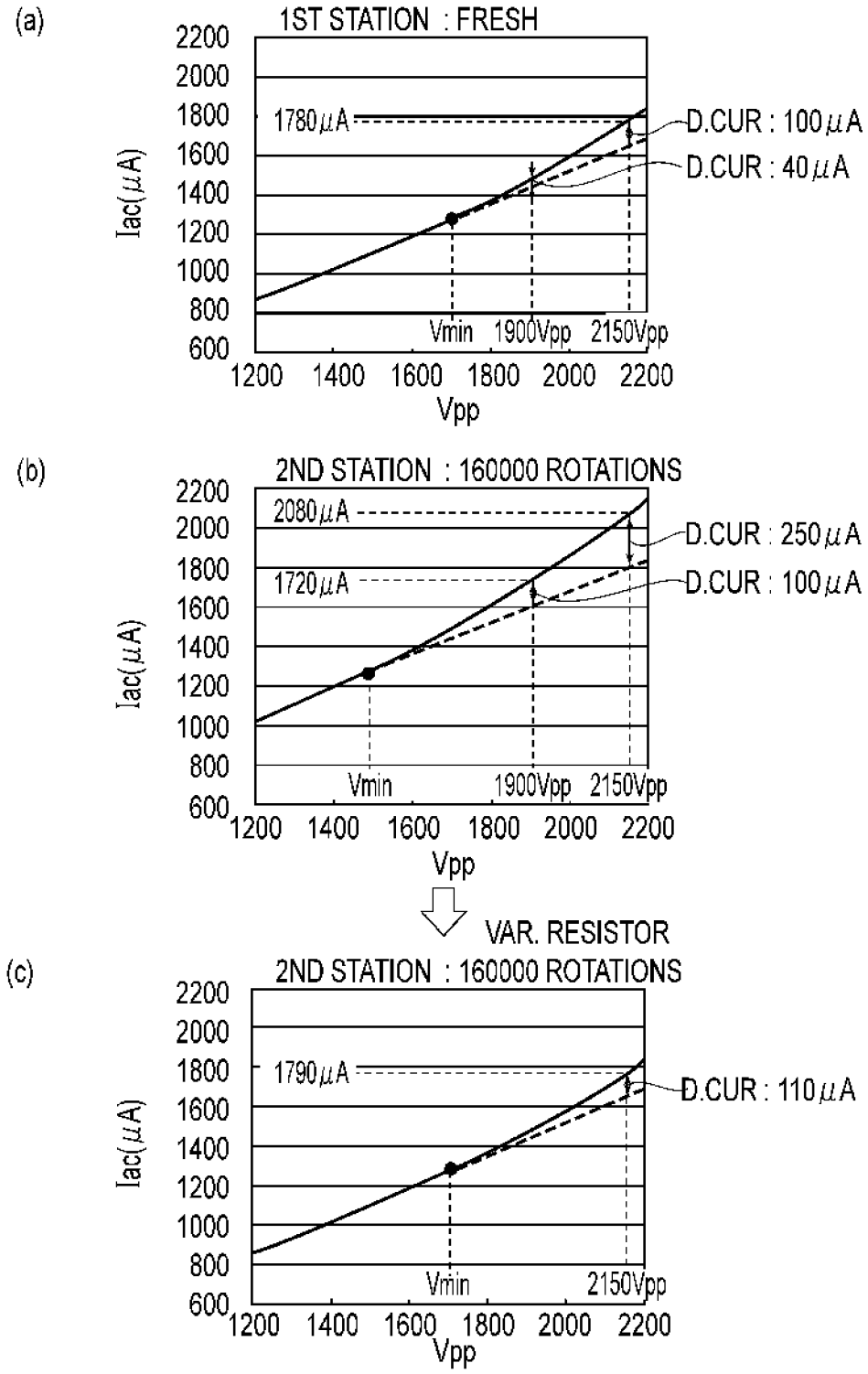
FIG. 10 is a graph showing an example of Vpp-Iac illustrating a principle of the control for the charging AC voltage in the image forming apparatus according to another embodiment of the present invention.

Parts (a), (b) and (c) of FIG. 10 show an example of the Vpp-Iac when the difference among the discharge currents of the first, second and third image forming stations Sa, Sb, Sc is large. Part (a) of FIG. 10 is a graph when the photosensitive drum 1*a* of the first image forming station Sa is fresh, and part (b) of FIG. 10 is a graph of the Vpp-Iac when the number of rotations of the photosensitive drum 1*b* of the second image forming station Sb is 160000 which means close to the end of the lifetime thereof.

With respect to FIG. 10, when the charging AC voltage is controlled so that the discharge current by the first image forming station Sa is 100 μA, the charging AC voltage of 2150 Vpp is applied to the first image forming station Sa. Then, the same 2150 Vpp is applied to the second image forming station Sb, too, if the charging AC voltage is applied in parallel by a single AC voltage source. In this case, the discharge current is 250 μA in the second image forming station Sb, which means slightly excessive discharge.

On the other hand, the charging AC voltage is controlled so that the discharge current by the second image forming station Sb is 100 μA, and the charging AC voltage of 1900 Vpp is applied to the second image forming station Sb. And, the same 1900 Vpp is applied to the first image forming station Sa, too. In this case, the discharge current in the first image forming station Sa is 40 μA, which means shortage of the discharge current with the result of the image defect attributable to the improper charging of the photosensitive drum 1, such as the sandpaper like background and/or foggy background.

As described in the foregoing, with the structure in which the charging AC voltages are applied in parallel to the charging members of the image forming stations from a single AC voltage source, the excessive discharge or the improper charging arises in a part of the image forming stations.

In view of this, in this embodiment, the variable resistors 40*a*, 40*b*, 40*c* are adjusted in accordance with the use situation of the photosensitive drums 1, more particularly, the numbers of rotations of the photosensitive drums 1, respectively.

The description will be made with respect to the example of FIG. 10. As shown in part (a) of FIG. 10, in the case that the photosensitive drum 1*a* of the first image forming station Sa is fresh, the variable resistor 40*a* is set to 0Ω. As shown in part (b) of FIG. 10, when the number of rotations of the photosensitive drum 1*b* of the second image forming station Sb is 160000, the electric capacity of the photosensitive drum 1*b* is large, so that the discharge readily occurs between the photosensitive drum 1*b* and the charging roller 2*b*. Therefore, in such a case, the variable resistor 40*b* is set to 5.0×10^6Ω. The charging AC voltage is 2150 Vpp which is suitable for a fresh photosensitive drum 1*a* of the first image forming station Sa. Part (c) of FIG. 10 shows Vpp-Iac in the second image forming station Sb in such a case. From part (c) of FIG. 10, the inclination in the graph of the Vpp-Iac in the second image forming station Sb at this time is substantially the same as the inclination in the graph (part (a) of FIG. 10) of the Vpp-Iac in the first image forming station Sa when the photosensitive drum 1 is fresh. The discharge current when the charging AC voltage of the 2150 Vpp is applied is 110 μA which is within the optimum range of the discharge current in this embodiment.

In this embodiment, the electric resistance of the variable resistor 40 is adjusted as follows. When the number of rotations of the photosensitive drum 1 is 0-10000, the resistance is 0Ω; when it is 10000-40000, the resistance is 1.0×10^5Ω; when it is 40000-80000, the resistance is 5.0×10^5Ω; when it is 80000-120000, the resistance is 1.0×10^6Ω; and when it is 120000-160000, the resistance is 5.0×10^6Ω. The charging AC voltage is set to 2150 Vpp required when photosensitive drum 1 is fresh, by which the discharge current can be controlled within the range of 100 μA±20 μA for all of the first-third image forming stations Sa-Sc, irrespective of the use situation of the photosensitive drum 1.

Figure 11:
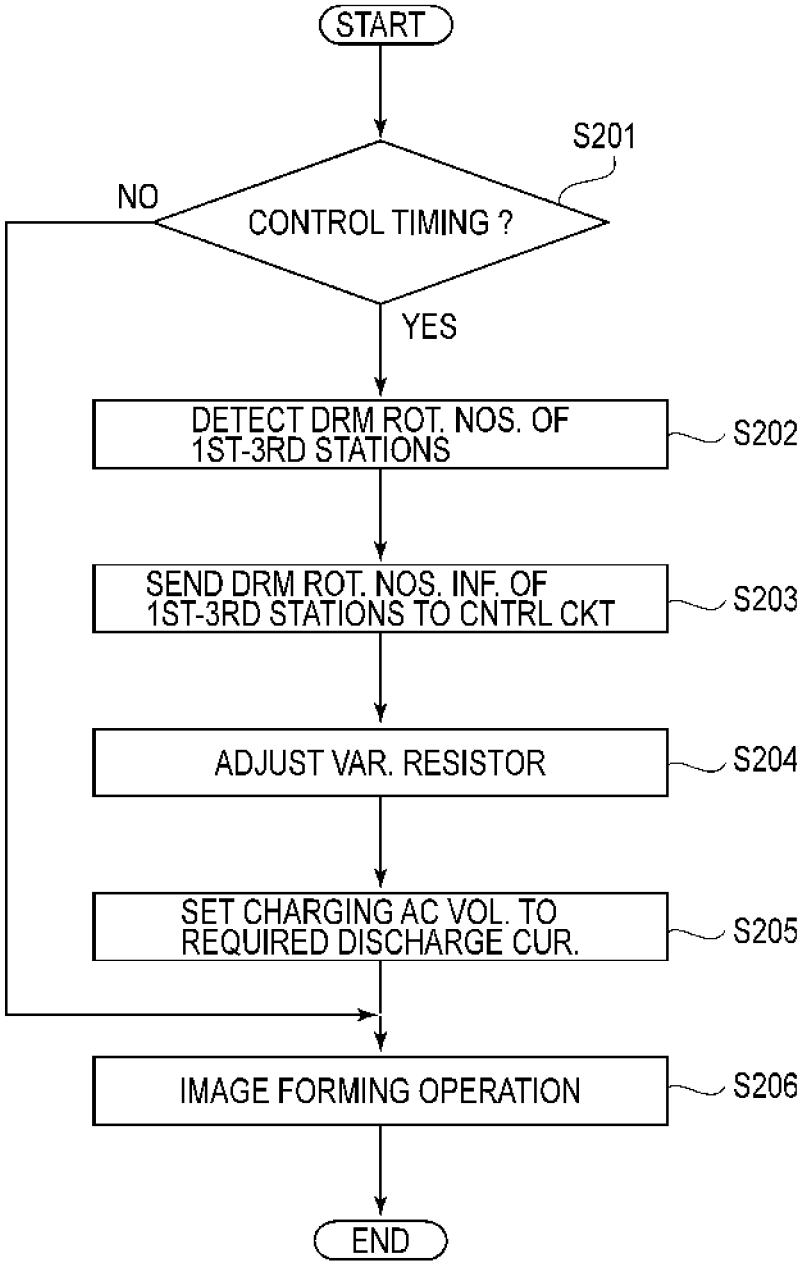
FIG. 11 is a flow chart showing a process of the control method for the charging AC voltage in the image forming apparatus according to another embodiment of the present invention.

FIG. 11 is a flowchart illustrating the control of adjusting the charging AC voltage applied to the charging rollers 2*a*, 2*b*, 2*c* of the color image formation portions Sa, Sb, Sc in which the AC voltage source is common in this embodiment.

The CPU 70 starts the process at the timing of the charging bias voltage control (at the printing preparation rotating operation in this embodiment) (S201). First, the counter 50 detects the numbers of rotations of the photosensitive drums 1*a*, 1*b*, 1*c* of the first, second and third image forming stations Sa, Sb, Sc (S202). The information of the numbers of rotations of the photosensitive drums 1*a*, 1*b*, 1*c* is transmitted to the memory 60. The CPU 70 adjusts the variable resistors 40*a*, 40*b*, 40*c* in response to the information of the numbers of rotations of the photosensitive drums 1*a*, 1*b*, 1*c* stored in the memory 60 as described above. After the adjustment of the variable resistors 40*a*, 40*b*, 40*c*, the CPU 70 determines (S205) the charging AC voltage required to provide the discharge current necessary for a fresh photosensitive drum 1 (number of rotations of the photosensitive drum=0), as the charging AC voltage to be applied during the printing step. In this embodiment, it is 2150 Vpp for the discharge current of 100 μA. The charging AC voltage of the charging voltage is constant-voltage-controlled during the image forming operation (S206).

If, in S201, the result of the discrimination indicates that it is not the timing of the charging bias voltage control, the processes S102-S105 are not carried out, and the image forming operation is executed with the previous setting of the charging AC voltage (S206).

As will be understood from the foregoing, in this embodiment, the use situation of the photosensitive member is discriminated by the number of rotations of the photosensitive member, and the image forming apparatus 100 includes means (counter) for the number of rotations of the photosensitive member as the use situation detecting means.

As described in the foregoing, according to this embodiment, the charging AC voltages are outputted to the plurality of image forming stations from the single AC voltage source, so that an inexpensive and small size structure can be accomplished. In such a structure, the variable resistors provided between the AC voltage source and the charging rollers 2 of the image forming stations are adjusted in accordance with the number of rotations of the photosensitive drums 1 of the image forming stations, respectively. By this, even if there is a difference in the wearing amount between the photosensitive drums 1 of the image forming stations, the discharge current in the optimum range can be provided with the same charging AC voltage.

Embodiment 3

A further embodiment will be described. The fundamental structures and operations of the image forming apparatus of this embodiment are the same as those of Embodiment 1. In the description of this embodiment, the same reference numerals as in Embodiment 1 are assigned to the elements having the corresponding functions in this embodiment, and the detailed description thereof is omitted for simplicity.

In Embodiment 1, the use situation of the photosensitive drum 1 is represented by the cumulated number of image formations, on the basis of which the electric resistance of the variable resistor 40 is adjusted. As shown in FIG. 3 of the operational sequence of the image forming apparatus 100, the image forming operation in Embodiment 2 includes the multiple pre-rotation period, the sheet interval period and the post-rotation step. Therefore, the scraping amount of the photosensitive drum 1 may be different between when the image formations are carried out continuously on 100 sheets and when they are carried out on 100 sheets non-continuously.

In view of this, in this embodiment, the counter 50 as the use situation detecting means detects the time (duration) of the charging AC voltage application to the charging roller 2 of the image forming station. In this embodiment, the counter 50 integrates the output time of the charging AC voltage application from the charging voltage source portion 21 and stores the integrated time.

Table 3 shows a relationship between the time of the charging AC voltage application and the optimum charging AC voltage to provide the 100 μA of the discharge current in this embodiment. The value of the optimum charging AC voltage changes for each 5 hours of the charging AC voltage application. Therefore, in this embodiment, it is desired to lower the charging AC voltage with increase of the time of the charging AC voltage application.

TABLE 3

| Cumulative charging AC voltage application duration (h) | Optimum applied voltage Vpp when discharging current is 100 μmA |
|---|---|
| 0 | 2150 |
| 5 | 2040 |
| 10 | 1980 |
| 15 | 1930 |
| 20 | 1900 |

However, when the charging AC voltage is applied to the charging rollers 2 of the image forming stations from the single AC voltage source as in this embodiment, the following problem arises.

If the cumulated charging AC voltage application durations to the photosensitive drums 1*a*, 1*b*, 1*c* of the first, second and third image forming stations Sa, Sb, Sc are the same, for example, the problem of the excessive discharge does not arise by changing the charging AC voltages for all of the image forming stations in accordance with Table 3. Or, if the photosensitive drums 1*a*, 1*b*, 1*c* of the first, second and third image forming stations Sa, Sb, Sc are replaced simultaneously, the problem of the excessive discharge does not arise.

However, the use situations of the first, second and third image forming stations Sa, Sb, Sc are different actually. The charging AC voltage application time may be different among the first, second and third image forming stations Sa, Sb, Sc, when the images are formed using one of the first, second and third image forming stations Sa, Sb, Sc, for example. If the photosensitive drums 1 of the first, second and third image forming stations Sa, Sb, Sc have to be simultaneously replaced, all the photosensitive drums 1 have to be replaced even if a problem arises in only one image forming station. From the standpoint of low running cost, the photosensitive drums 1 are replaceable independently from each other in the recent image forming apparatus in most cases.

Therefore, in the image forming apparatus 100 of this embodiment, when the charging AC voltage application time in an image forming station reaches 20 hours, a message promoting the replacement of the particular photosensitive drum 1 is indicated on an operating portion (unshown) of the image forming apparatus 100.

Therefore, when the photosensitive drums 1 of the first, second and third image forming stations Sa, Sb, Sc are not replaced simultaneously, or when the charging AC voltage application time (cumulated durations) of any of the photosensitive drums 1 of the first, second and third image forming stations Sa, Sb, Sc is large, the following results. With the structure in which the charging AC voltages are applied in parallel by a single AC voltage source, the difference of the discharge current among the image forming stations may be large.

Figure 12:
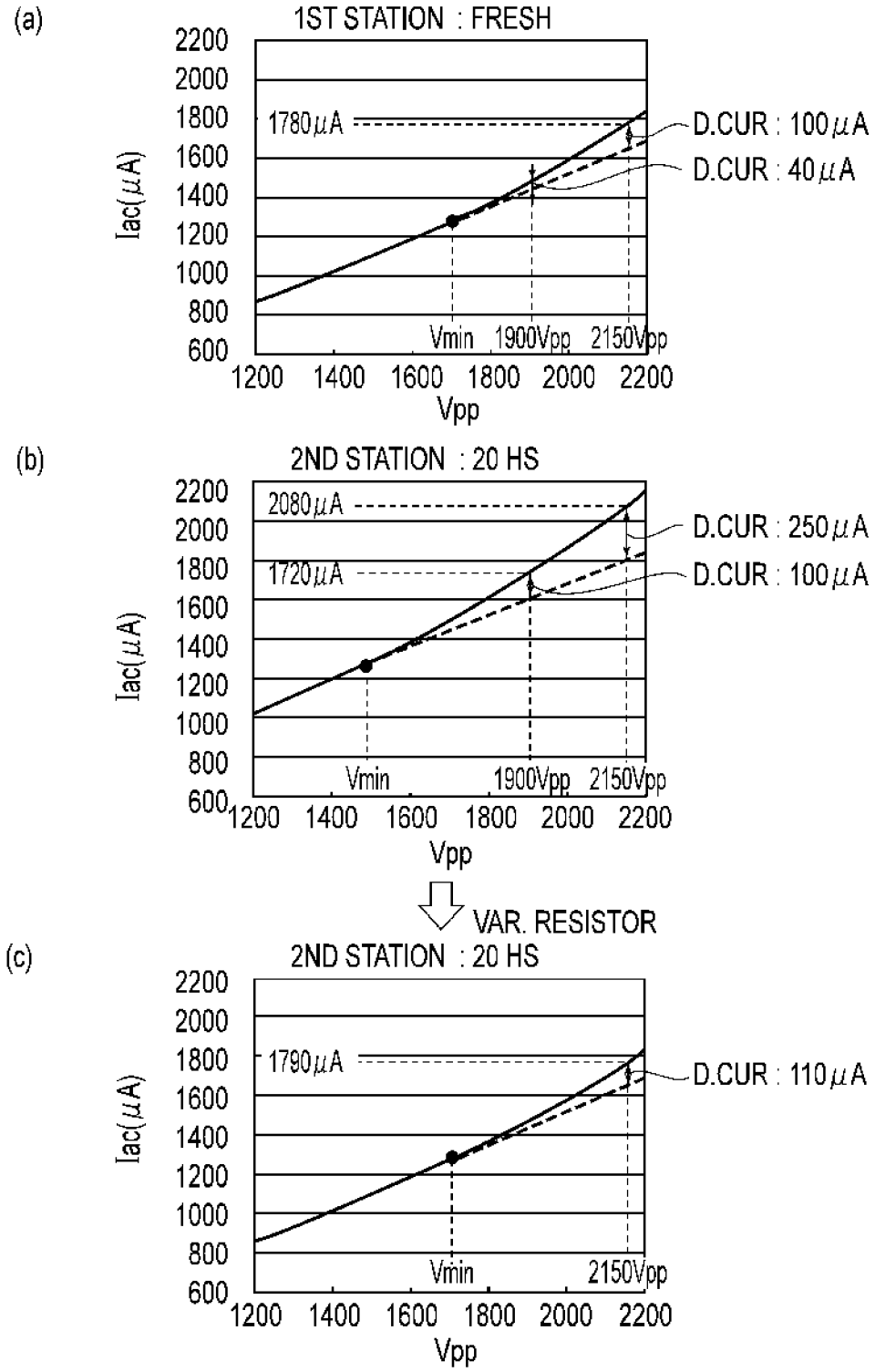
FIG. 12 is a graph showing an example of Vpp-Iac illustrating a principle of the control for the charging AC voltage in the image forming apparatus according to a further embodiment of the present invention.

Parts (a), (b) and (c) of FIG. 12 show an example of the Vpp-Iac when the difference among the discharge currents of the first, second and third image forming stations Sa, Sb, Sc is large. Part (a) of FIG. 12 is a graph when the photosensitive drum 1*a* of the first image forming station Sa is fresh, and part (b) of FIG. 12 is a graph of the Vpp-Iac when the charging AC voltage application time of the second image forming station Sb is 20 hours, which means close to the end of the lifetime thereof.

With respect to FIG. 12, when the charging AC voltage is controlled so that the discharge current by the first image forming station Sa is 100 μA, the charging AC voltage of 2150 Vpp is applied to the first image forming station Sa. Then, the same 2150 Vpp is applied to the second image forming station Sb, too, if the charging AC voltage is applied in parallel by a single AC voltage source. In this case, the discharge current is 250 μA in the second image forming station Sb, which means slightly excessive discharge.

On the other hand, the charging AC voltage is controlled so that the discharge current by the second image forming station Sb is 100 μA, and the charging AC voltage of 1900 Vpp is applied to the second image forming station Sb. And, the same 1900 Vpp is applied to the first image forming station Sa, too. In this case, the discharge current in the first image forming station Sa is 40 IAA, which means shortage of the discharge current with the result of the image defect attributable to the improper charging of the photosensitive drum 1, such as the sandpaper like background and/or foggy background.

As described in the foregoing, with the structure in which the charging AC voltages are applied in parallel to the charging members of the image forming stations from a single AC voltage source, the excessive discharge or the improper charging arises in a part of the image forming stations.

In view of this, in this embodiment, the variable resistors 40*a*, 40*b*, 40*c* are adjusted in accordance with the use situation of the photosensitive drums 1, more particularly, the charging AC voltage application times, respectively.

The description will be made with respect to the example of FIG. 12. As shown in part (a) of FIG. 12, in the case that the photosensitive drum 1*a* of the first image forming station Sa is fresh, the variable resistor 40*a* is set to 0Ω. As shown in part (b) of FIG. 12, when the charging AC voltage application time of the second image forming station Sb is 20 hours, the electric capacity of the photosensitive drum 1*b* is large, so that the discharge readily occurs between the photosensitive drum 1*b* and the charging roller 2*b*. Therefore, in such a case, the variable resistor 40*b* is set to 5.0×10^6Ω. The charging AC voltage is 2150 Vpp, which is suitable for a fresh photosensitive drum 1*a* of the first image forming station Sa. Part (c) of FIG. 12 shows Vpp-Iac in the second image forming station Sb in such a case.

From part (c) of FIG. 12, the inclination in the graph of the Vpp-Iac in the second image forming station Sb at this time is substantially the same as the inclination in the graph (part (a) of FIG. 12) of the Vpp-Iac in the first image forming station Sa when the photosensitive drum 1 is fresh. The discharge current when the charging AC voltage of the 2150 Vpp is applied is 110 μA, which is within the optimum range of the discharge current in this embodiment.

When the charging AC voltage application time is 0 (fresh)-2 hrs, the resistance is 0Ω; when it is 2-5 hrs, the resistance is 1.0×10^5Ω; when it is 5-10 hrs, the resistance is 5.0×10^5Ω; when it is 10-15 hrs, the resistance is 1.0×10^6Ω; and when it is 15-20 hrs, the resistance is 5.0×10^6Ω. The charging AC voltage is set to 2150 Vpp required when photosensitive drum 1 is fresh, by which the discharge current can be controlled within the range of 100 μA±20 μA for all of the first-third image forming stations Sa-Sc, irrespective of the use situation of the photosensitive drum 1.

Figure 13:
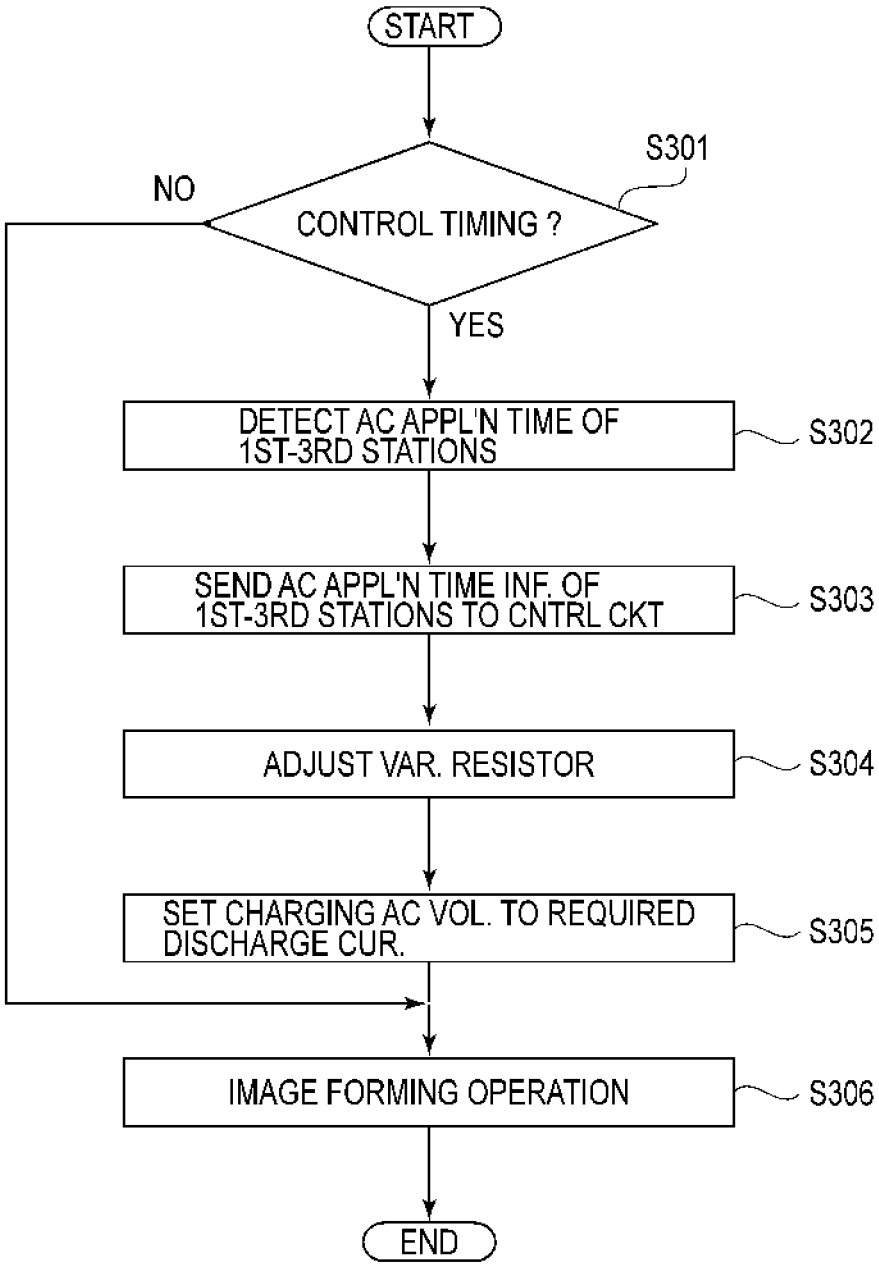
FIG. 13 is a flow chart showing a process of the control method for the charging AC voltage in the image forming apparatus according to a further embodiment of the present invention.

FIG. 13 is a flowchart illustrating the control of adjusting the charging AC voltage applied to the charging rollers 2*a*, 2*b*, 2*c* of the color image formation portions Sa, Sb, Sc in which the AC voltage source is common in this embodiment.

The CPU 70 starts the process at the timing of the charging bias voltage control (at the printing preparation rotating operation in this embodiment) (S301). First, the counter 50 detects the charging AC voltage application time of the photosensitive drums 1*a*, 1*b*, 1*c* of the first, second and third image forming stations Sa, Sb, Sc (S302). The information of the charging AC voltage application time is transmitted to the memory 60 (S303). The CPU 70 adjusts the variable resistors 40*a*, 40*b*, 40*c* in response to the information of the charging AC voltage application time of the first, second and third image forming stations Sa, Sb, Sc stored in the memory 60 as described above, respectively (S304). After the adjustment of the variable resistors 40*a*, 40*b*, 40*c*, the CPU 70 determines (S305) the charging AC voltage required to provide the discharge current necessary for a fresh photosensitive drum 1 (charging AC voltage application time=0), as the charging AC voltage to be applied during the printing step (S305). In this embodiment, it is 2150 Vpp for the discharge current of 100 μA. The charging AC voltage of the charging voltage is constant-voltage-controlled during the image forming operation (S306).

If, in S101, the result of the discrimination indicates that it is not the timing of the charging bias voltage control, the processes S102-S105 are not carried out, and the image forming operation is executed with the previous setting of the charging AC voltage (S306).

In this embodiment, the use situation of the photosensitive member is discriminated on the basis of the cumulated charging time of the photosensitive member by the charging member, and the image forming apparatus 100 is provided with counting means (counter) for counting the charging time as the use situation detecting means.

As described in the foregoing, according to this embodiment, the charging AC voltages are outputted to the plurality of image forming stations from the single AC voltage source, so that an inexpensive and small size structure can be accomplished. With such a structure, the variable resistors 40 provided between the AC voltage source and the charging rollers 2 of the image forming stations are adjusted in accordance with the charging AC voltage application time of the image forming station, respectively. By this, even if there is a difference in the wearing amount between the photosensitive drums 1 of the image forming stations, the discharge current in the optimum range can be provided with the same charging AC voltage.

Embodiment 4

Another embodiment will be described. The fundamental structures and operations of the image forming apparatus of this embodiment are the same as those of Embodiment 1. In the description of this embodiment, the same reference numerals as in Embodiment 1 are assigned to the elements having the corresponding functions in this embodiment, and the detailed description thereof is omitted for simplicity.

Figure 14:
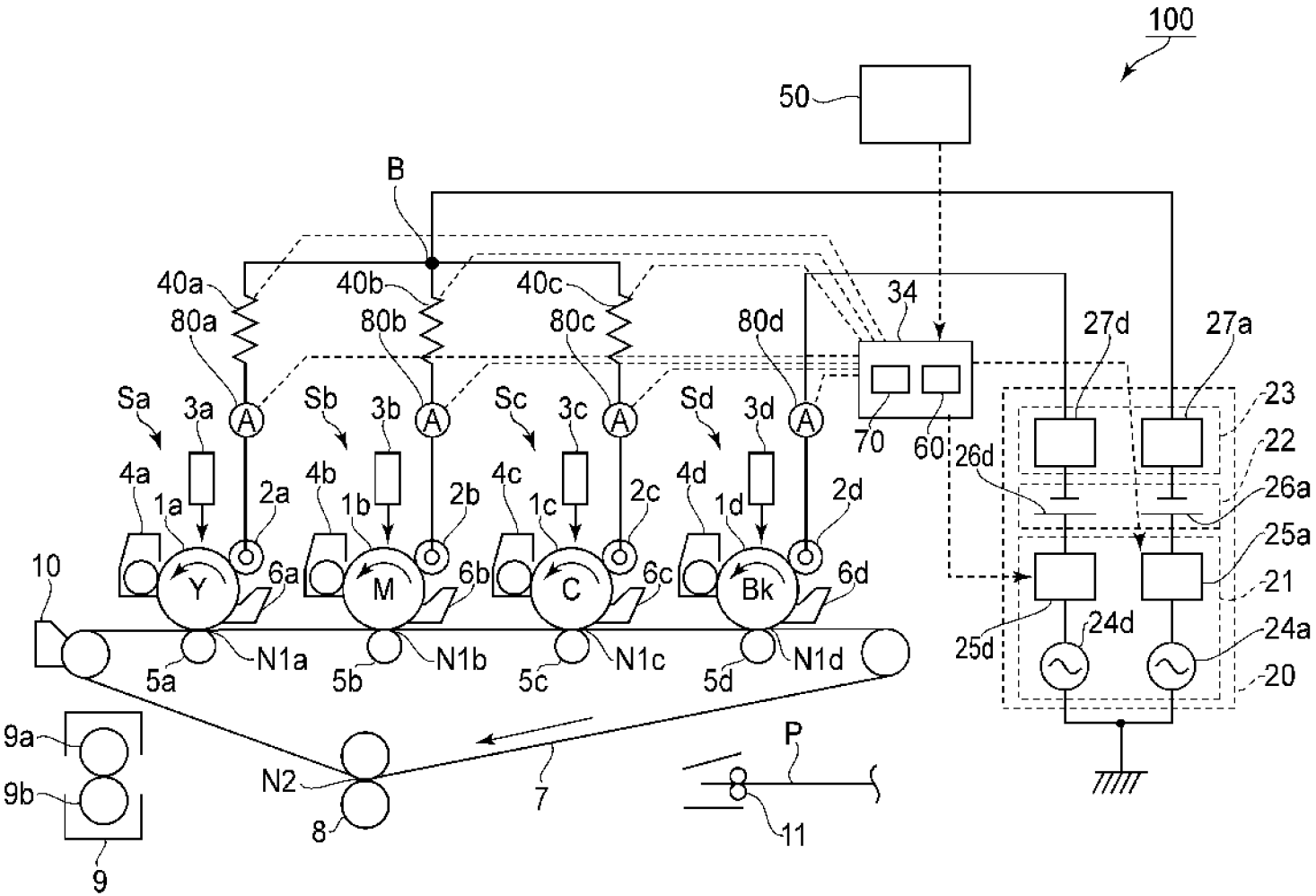
FIG. 14 is a schematic illustration of an image forming apparatus according to a further embodiment of the present invention.

FIG. 14 is a schematic view showing a general arrangement of the image forming apparatus 100 according to this embodiment of the present invention. In the image forming apparatus 100 of this embodiment shown in FIG. 14, DC current measuring devices 80*a*, 80*b*, 80*c*, 80*d* replace the AC current measuring devices 30*a*, 30*b*, 30*c*, 30*d* of the image forming apparatus shown in FIG. 1. In this embodiment, the information of the DC current measured by DC current measuring device 80 is inputted to the control circuit 34.

Figure 15:
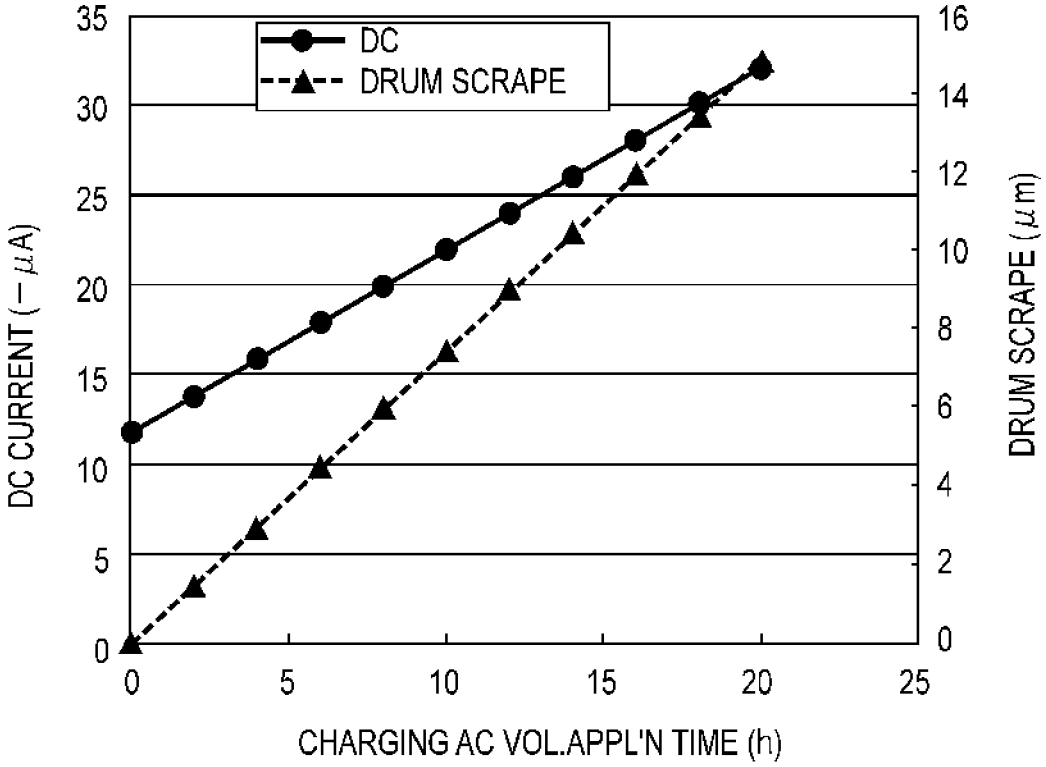
FIG. 15 is a graph of a relation between a charging AC voltage application time and the scraping amount of the photosensitive drum, and a relation between the charging AC voltage application time and a charging DC current, in an image forming apparatus according to a further embodiment of the present invention.

FIG. 15 shows the results of investigations as to the relationship between the charging AC voltage application time (h) and the wearing amount of the charge transfer layer of the photosensitive drum 1 (scraping amount of the photosensitive drum 1) (μm) in the image forming apparatus 100 of this embodiment. FIG. 15 also shows a relationship between the charging AC voltage application time (h) and the DC current (−μA) measured in the DC current measuring devices 80*a*, 80*b*, 80*c*, 80*d*.

Here, the measuring conditions for the DC current are as follows. A charged potential of the photosensitive drum 1 is −500V; a primary transfer bias applied to a primary transfer roller 5 is +500V; the temperature is 23° C.; and the humidity is 5%.

From FIG. 15, it is understood that the scraping amount of the photosensitive drum 1 monotonely increases with the charging AC voltage application time. In addition, it is understood from FIG. 15 that scraping of the photosensitive drum 1 leads to increase of the electric capacity of the photosensitive drum 1 and to the monotone increase of the DC current.

Similarly to Embodiment 3, it is effective that the scraping amount of the photosensitive drum 1 is predicted from the charging AC voltage application time, and is fed forward to the adjusting value for the variable resistor 40*a*, 40*b*, 40*c*. On the other hand, as described hereinbefore, by measuring the DC current, the scraping amount of the photosensitive drum 1 can be predicted with high accuracy, and can be fed back to the adjusting value of the variable resistor 40*a*, 40*b*, 40*c*.

In this embodiment, the electric resistance of the variable resistor 40 is adjusted as follows. When the measured DC current is 12-14 (−μA), the resistance is 0Ω; and when it is 14-17 (−μA), it is 1.0×10^5Ω. In addition, when the measured DC current is 17-22 (−μA), the resistance is 5.0×10^5Ω; when it is 22-27 (−μA), the resistance is 1.0×10^6Ω; and when it is 27-32 (−μA), the resistance is 5.0×10^6Ω. The charging AC voltage is set to 2150 Vpp required when photosensitive drum 1 is fresh, by which the discharge current can be controlled within the range of 100 μA±20 μA for all of the first-third image forming stations Sa-Sc, irrespective of the use situation of the photosensitive drum 1.

Figure 16:
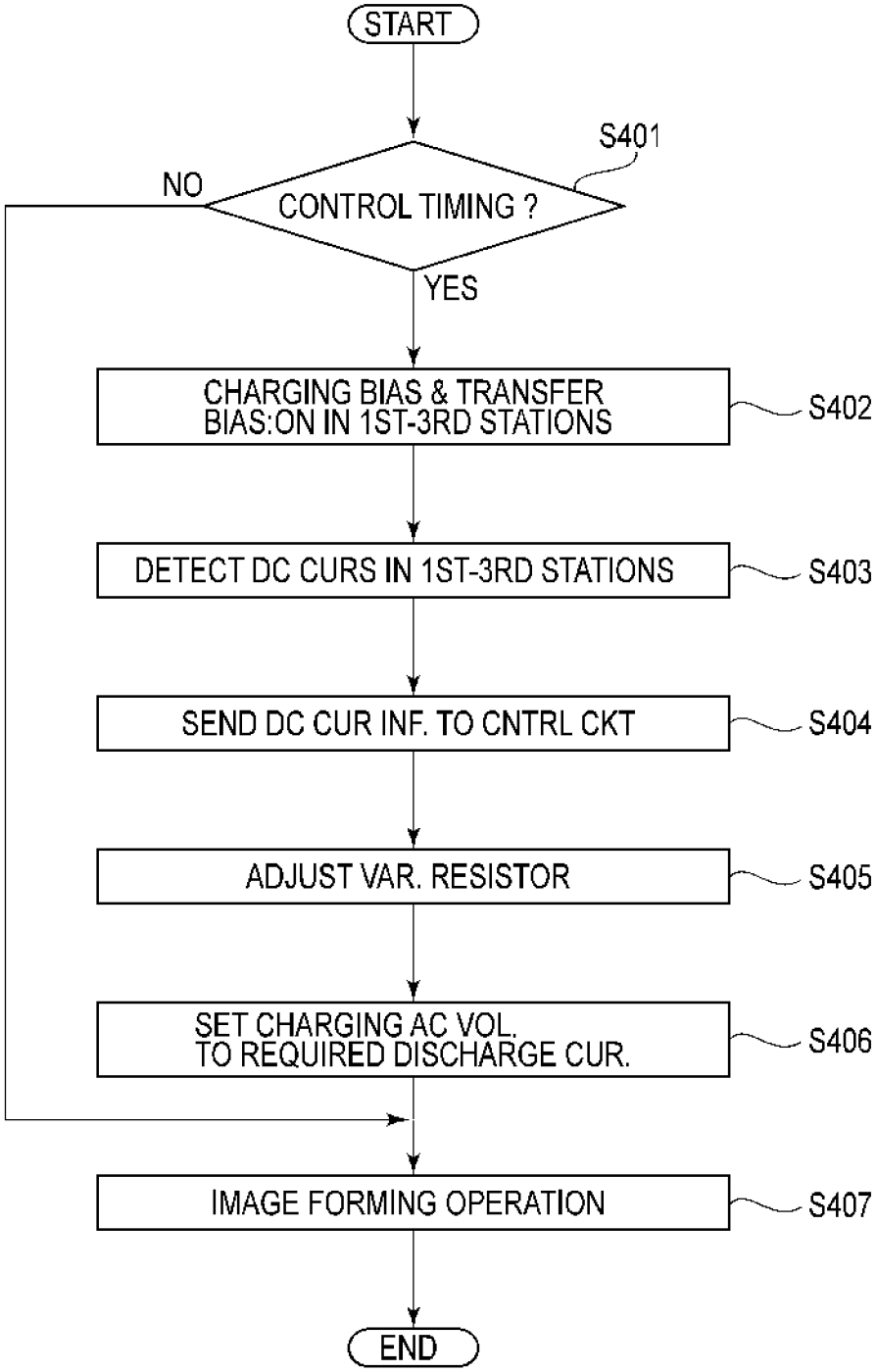
FIG. 16 is a flow chart showing a process of the control method for the charging AC voltage in the image forming apparatus according to a further embodiment of the present invention.

FIG. 16 is a flowchart illustrating the control of adjusting the charging AC voltage applied to the charging rollers 2*a*, 2*b*, 2*c* of the color image formation portions Sa, Sb, Sc in which the AC voltage source is common in this embodiment.

The CPU 70 starts the process at the timing of the charging bias voltage control (at the printing preparation rotating operation in this embodiment) (S401). First, the CPU 70 applies a charging bias voltage having the charging DC voltage and the charging AC voltage of 2150 Vpp, and applies a primary transfer bias voltage of +500V in order to provide the charging voltage of −500V in each of the first, second and third image forming stations Sa, Sb, Sc. Then, in the DC current measuring devices 80*a*, 80*b*, 80*c*, DC currents flowing between the charging roller 2 and the photosensitive drum 1 in the first, second and third image forming stations Sa, Sb, Sc are measured (S403). The measured DC currents are transmitted in the memory 60 (S405). The CPU 70 adjusts the variable resistors 40*a*, 40*b*, 40*c* in response to the DC currents of the first, second and third image forming stations Sa, Sb, Sc stored in the memory 60 as described above, respectively (S405). After the adjustment of the variable resistors 40*a*, 40*b*, 40*c*, the CPU 70 determines (S406) the charging AC voltage required to provide the discharge current necessary for a fresh photosensitive drum 1 (DC current=−12 μA) as the charging AC voltage to be applied during the printing step. In this embodiment, it is 2150 Vpp for the discharge current of 100 μA. The charging AC voltage of the charging voltage is constant-voltage-controlled during the image forming operation (S407).

If, in S401, the result of the discrimination indicates that it is not the timing of the charging bias voltage control, the processes S402-S406 are not carried out, and the image forming operation is executed with the previous setting of the charging AC voltage (S407).

As will be understood from the foregoing, in this embodiment, the image forming apparatus 100 includes an AC voltage source 21 for outputting the AC voltage to be applied commonly to at least two charging members. The image forming apparatus 100 includes control means for controlling the AC voltage to be applied to at least two charging members from the AC voltage source. The image forming apparatus 100 includes variable resistors 40 connected between the AC voltage source 21 and the at least two charging members, respectively. In addition, the image forming apparatus 100 includes the DC current measuring device 80 for measuring the DC current flowing through at least two charging members when the photosensitive member is charged. The image forming apparatus 100 includes adjusting means for adjusting the electric resistances of the variable resistors 40, respectively. In this embodiment, the CPU 70 has functions of the control means and the adjusting means. In this embodiment, the control means applies, from the AC voltage source 21 to the at least two charging members, the AC voltage set such that the predetermined discharge current is provided when the DC current measuring device 80 detects a predetermined DC current upon the image formation. The adjusting means adjusts the electric resistance of the variable resistors 40 connected to the at least two charging members, respectively, in image formation, in the following manner. That is, the adjustment is effected in accordance with the DC current detected from the at least two charging members by the DC current measuring device 80 during the non-image-formation, so that the discharge currents within the predetermined range are provided between the at least two charging members and the associated photosensitive members, respectively.

As described in the foregoing, according to this embodiment, the charging AC voltages are outputted to the plurality of image forming stations from the single AC voltage source, so that an inexpensive and small size structure can be accomplished. With such a structure, the variable resistors 40 provided between the AC voltage source and the charging rollers 2 of the image forming stations are adjusted in accordance with the results of the detections of the scraping amounts of the photosensitive drums 1 of the image forming stations by detecting the charging DC currents. By this, even if there is a difference in the wearing amount between the photosensitive drums 1 of the image forming stations, the discharge current in the optimum range can be provided with the same charging AC voltage.

Embodiment 5

A further embodiment will be described. The fundamental structures and operations of the image forming apparatus of this embodiment are the same as those of Embodiment 1. In the description of this embodiment, the same reference numerals as in Embodiment 1 are assigned to the elements having the corresponding functions in this embodiment, and the detailed description thereof is omitted for simplicity.

In Embodiments 1-4, the Vpp-Iac relations of the first, second and third image forming stations Sa, Sb, Sc are controlled by adjusting the variable resistors 40*a*, 40*b*, 40*c* so that the target discharge current is provided.

However, the discharge current changes depending on the ambient condition, the use amount of the photosensitive drum 1 or the like. This is because the property of the Vpp-Iac gradually changes, and therefore, the discharge current is not completely constant. Therefore, in Embodiments 1-4, a tolerance of ±20 μA is given to the necessary discharge current 100 μA.

In this embodiment, in order to provide a further accurate necessary discharge current, the following control operations are carried out. The discharge current control in this embodiment will be described with respect to one image forming station, that is, one charging roller. A determination method of a charging AC voltage when a common AC voltage source is used for a plurality of image forming stations will be described in detail hereinafter.

Here, when the necessary discharge current is D, a charging AC voltage providing the discharge current D is determined.

Figure 17:
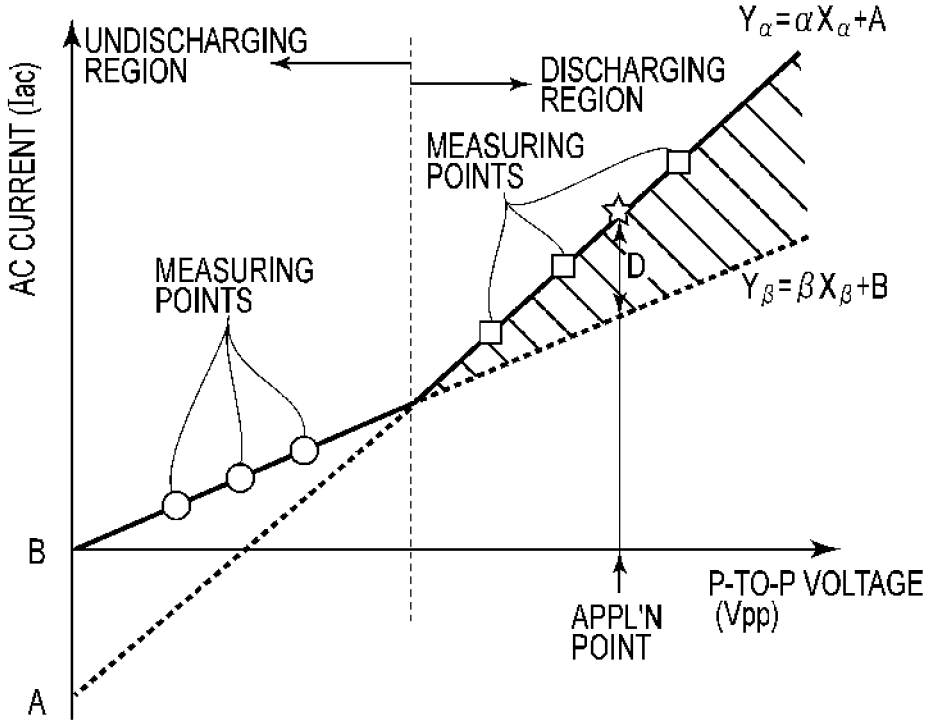
FIG. 17 is an illustration of a control method for the charging AC voltage in an image forming apparatus according to a further embodiment of the present invention.

First, as shown in FIG. 17 a control circuit 34 controls an AC voltage circuit 21 to apply sequentially three charging AC voltages in the discharge range and three charging AC voltages in the un-discharging range. When these charging AC voltages are applied, the AC currents Iac flowing into the charging rollers 2 are measured by the associated AC current measuring devices 30, and are inputted to the control circuit 34.

Figure 18:
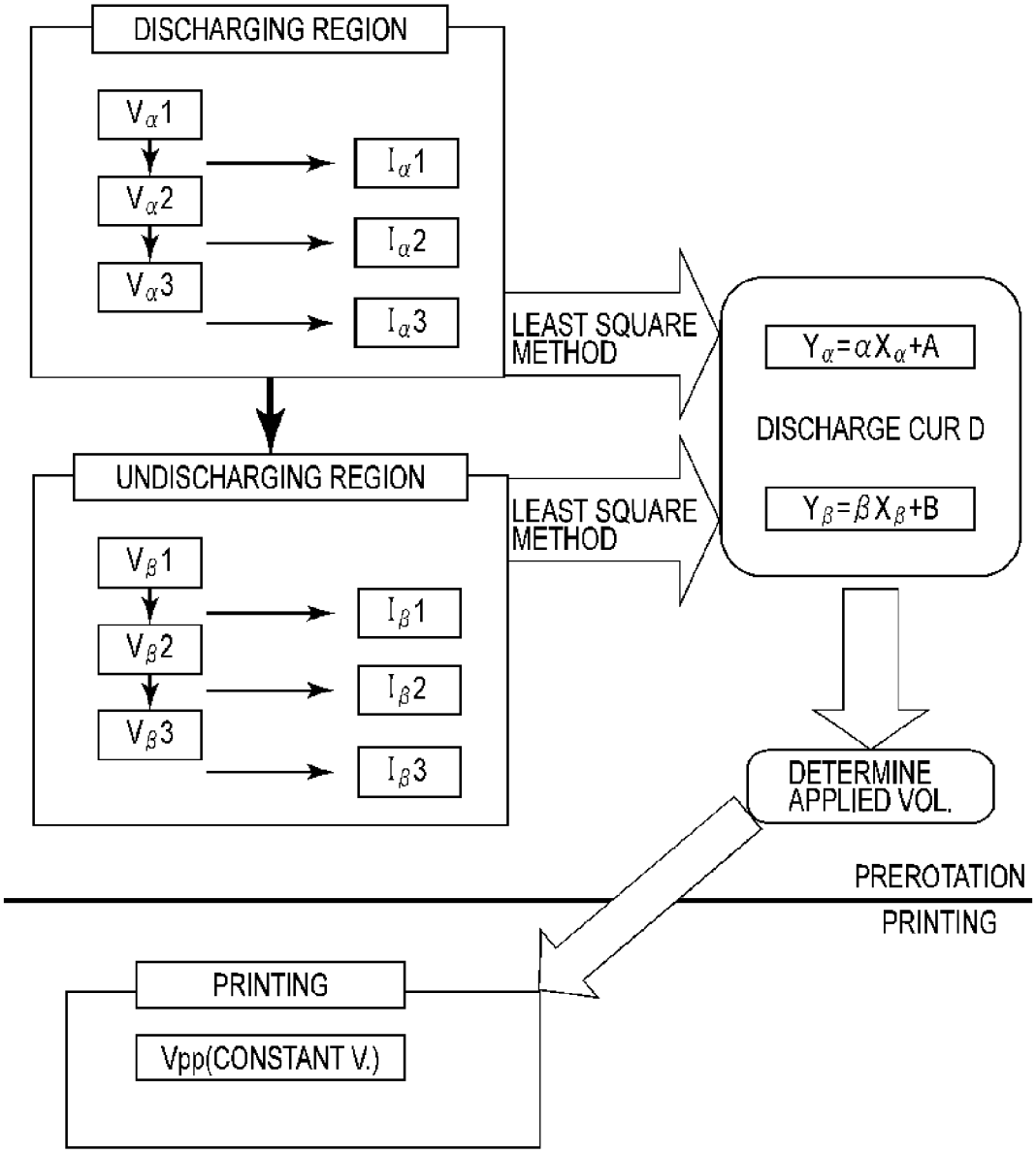
FIG. 18 is an illustration of a control method for the charging AC voltage in an image forming apparatus according to a further embodiment of the present invention.

Then, as shown in FIG. 18, the control circuit 34 effects a linear approximation of the relation between the charging AC voltage and the charging AC current using a least square approximation from the measured currents in the discharging region and un-discharging range, thus providing the following formulas:

Approximated line for the discharge range:

$$Y\alpha=\alpha X\alpha+A \quad (2)$$

Approximated line for the un-discharging range:

$$Y\beta=\beta X\beta+B \quad (3)$$

Thereafter, the control circuit 34 determines the charging AC voltage Vpp with which the difference between the formula (2) and the formula (3) is the discharge current D, by the following:

$$Vpp=(D-A+B)/(\alpha-\beta) \quad (4)$$

Here, this results as follows, since the difference between the formula (2) and the formula (3) is D, $$Y\alpha-Y\beta=(\alpha X\alpha+A)-(\beta X\beta+B)=D$$

Then, X=Vpp providing D satisfies, $$(\alpha Vpp+A)-(\beta Vpp+B)=D.$$

Therefore, $$Vpp=(D-A+B)/(\alpha-\beta).$$

In the printing step, the charging AC voltage applied to the charging roller 2 is switched to the value determined by equation (4), with which the constant-voltage-control is carried out.

In this manner, in this embodiment, for every printing preparation rotating operation, the charging AC voltage required to provide the discharge current necessary in the printing step is calculated. During the printing step, the determined charging AC voltage is applied with a constant voltage control. By this, variations in the electric resistances or the variations in the properties of the voltage source circuits of the image forming apparatus 100 which are attributable to the manufacturing errors and/or material property variations due to the ambient condition variation of the charging roller 2 and the photosensitive drum 1 can be accommodated, and therefore, further correct discharge current can be provided.

The control of the charging AC voltage supplied from the common AC voltage source and applied to the charging rollers 2*a*, 2*b*, 2*c* of the color image formation portions Sa, Sb, Sc will be described. Here, the charging AC voltage applied to the charging roller 2*d* of the black image forming station Sd can be obtained directly through the above-described method.

Figure 19:
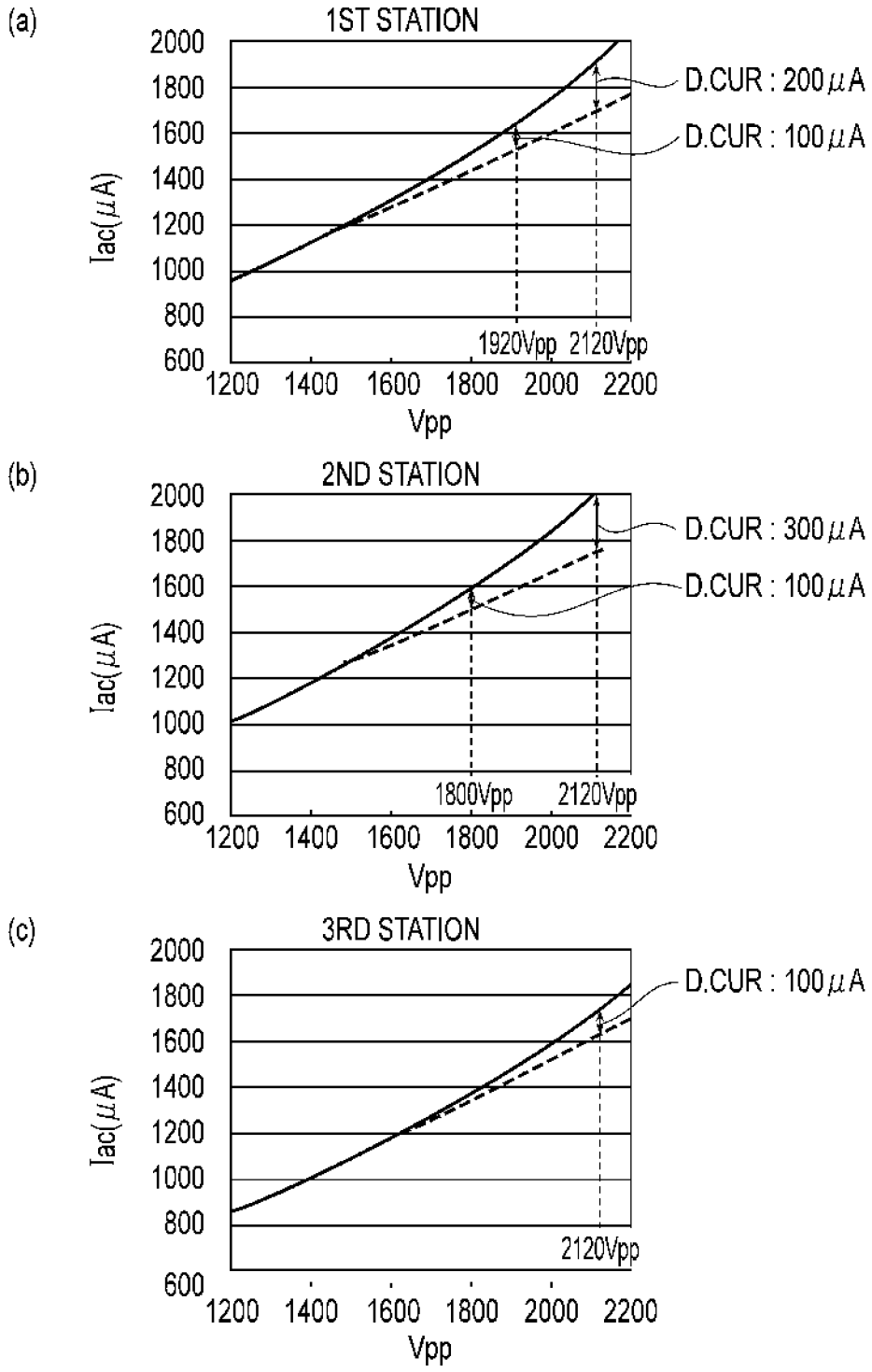
FIG. 19 is a graph of an example of Vpp-Iac in the color image formation portion of the image forming apparatus according to a further embodiment of the present invention.

Parts (a), (b) and (c) of FIG. 19 shows an example of the relationship (Vpp-Iac) between the charging AC voltage Vpp and the charging AC current Iac obtained for the first, second and third image forming stations Sa, Sb, Sc, respectively.

As shown in FIG. 19, the plots of Vpp-Iac of the first, second and third image forming stations Sa, Sb, Sc may be deviated due to the difference in the use frequency, the replacement timing of the photosensitive drum 1, the electric resistance of the charging roller 2 or the like. As a result, in the example of FIG. 19, the required charging AC voltages calculated through the above-described method of this embodiment when the required discharge current is 100 μA are as follows: In the first image forming station Sa, it is 1920 Vpp; in the second image forming station Sb, it is 1800 Vpp; and in the third image forming station Sc, it is 2120 Vpp.

In the case that the voltage source for applying the charging AC voltage to the charging member of each image forming station is provided, the required charging AC voltage is determined for each image forming station, and the obtained charging AC voltage is applied to the charging member of the associated image forming station, by which the proper discharge current can be provided. However, a common voltage source is used to apply the charging AC voltages to the charging members of the image forming stations; it is not possible to apply different charging AC voltages to the image forming stations.

Figure 20:
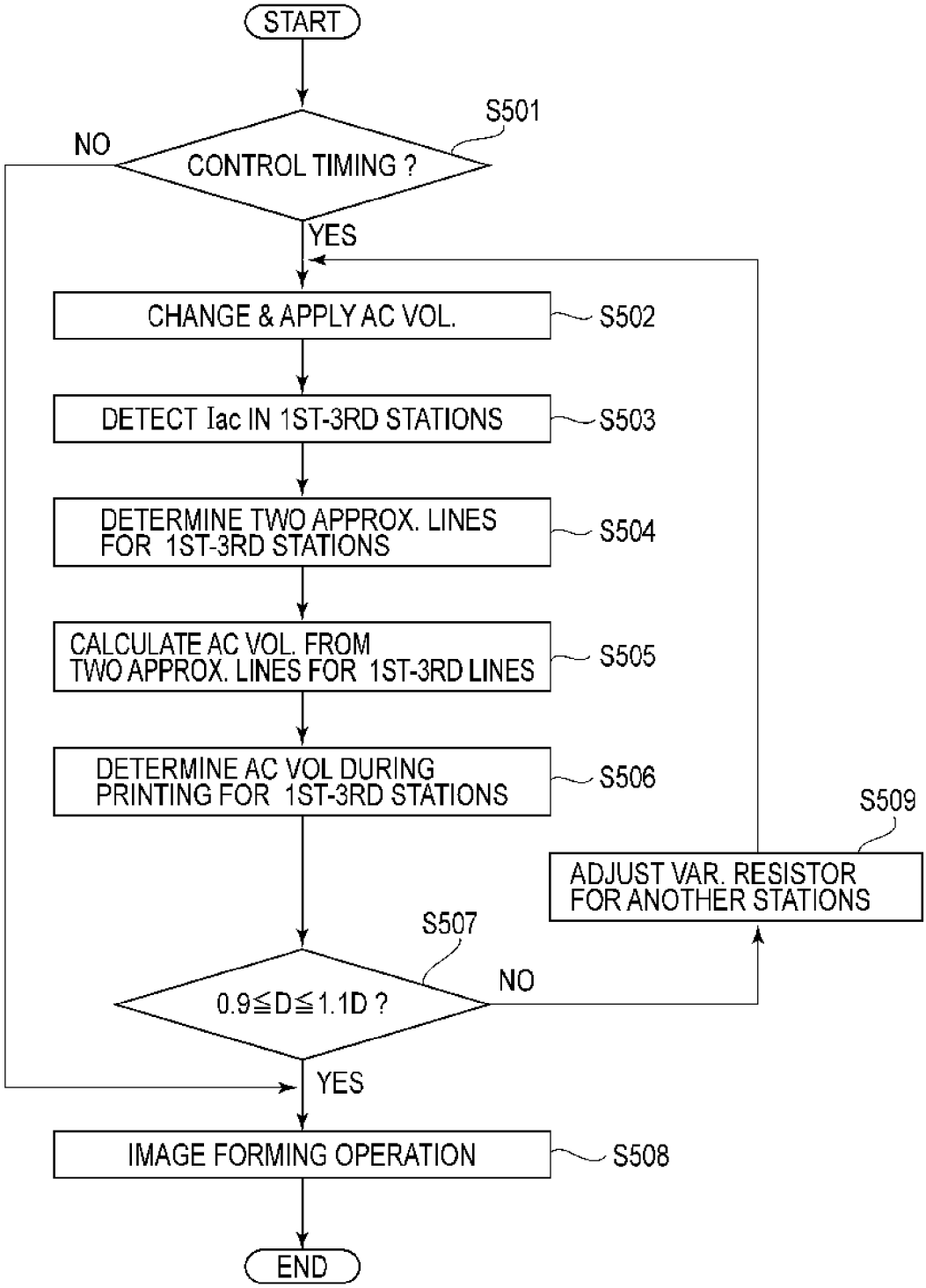
FIG. 20 is a flow chart showing a process of the control method for the charging AC voltage in the image forming apparatus according to a further embodiment of the present invention.

FIG. 20 shows a process of controlling the charging AC voltage applied to the charging rollers 2*a*, 2*b*, 2*c* of the color image formation portions Sa, Sb, Sc from the common AC voltage source.

The CPU 70 starts the process at the timing of the charging bias voltage control (at the printing preparation rotating operation in this embodiment) (S501). First, the charging AC voltages applied to the charging rollers 2*a*, 2*b*, 2*c* are sequentially switched to three points in the discharge range and three points in the un-discharging range by the first AC amplifying circuit 25*a* (S502). When the charging AC voltages are outputted, the charging AC voltages are measured by the AC current measuring devices 30*a*, 30*b*, 30*c* for the first, second and third image forming stations Sa, Sb, Sc, respectively, and the measurements are stored in the memory 60 (S503).

Then, the CPU 70 calculates two approximated lines through the calculating method described in conjunction with FIGS. 17, 18, from the information of the charging AC currents stored in the memory 60 (S504). The information includes the information for the three points (Vα1, Iα1), (Vα2, Iα2), (Vα3, Iα3) in the discharge range, and the information for the three points (Vβ1, Iβ1), (Vβ2, Iβ2), (vβ3, Iβ3) in the un-discharging range.

Then, the CPU 70 calculates the required charging AC voltage for the required discharge current for each of the first, second and third image forming stations Sa, Sb, Sc using formula 4 (S505). In this embodiment, the required discharge current is 100 μA. The required charging AC voltages for the discharge current of 100 μA obtained by the calculation are, as shown in FIG. 19, for example, 1920 Vpp in the first image forming station Sa, 1800 Vpp in the second image forming station Sb and 2120 Vpp in the third image forming station Sc. In this case, in this embodiment, the CPU 70 selects 2120 Vpp, which is for the third image forming station Sc and which is the maximum charging AC voltage, as the charging AC voltages applied to the color image formation portions Sa, Sb, Sc during the printing step (S506).

Then, the CPU 70 discriminates whether or not the selected charging AC voltage is within 10% tolerances relative to the discharge currents D required by the first image forming station Sa and the second image forming station Sb, respectively, which are other than the image forming station (maximum value) (S507), that is, $$0.9D \leq D \leq 1.1D.$$

The CPU 70 can determine the discharge currents for the first and second image forming stations Sa, Sb from the two approximated lines calculated for the first and second image forming stations Sa, Sb. In this embodiment, the required discharge current D is 100 μA, and therefore, the discrimination is whether or not it is within 90-110 μA.

In the example of FIG. 19, if the charging AC voltage of 2120 Vpp is outputted similarly to the third image forming station Sc, the discharge current is 200 μA in the first image forming station Sa, and the discharge current is 300 μA in the second image forming station Sb, which do not fall within the 10% tolerance range.

In such a case (S507), the CPU 70 adjusts the variable resistor 40 provided for the image forming station (s) other than the maximum value image forming station (S509). More particularly, the CPU 70 adjusts the variable resistors 40 of the other image forming stations so that the Vpp-Iac relations approach that of the image forming station with which the required charging AC voltage is the maximum. The increments of the variable resistance may be determined properly in consideration of the desired accuracy and resulting complication, but five step change as in the foregoing embodiments is one of practical selections.

In the example of FIG. 19, the variable resistor 40*c* in the third image forming station Sb is 0Ω; the variable resistor 40*a* to first image forming station Sa is 1.0×10^6Ω; and the variable resistor 40*b* in the second image forming station Sb is 5.0×10^6Ω. By doing so, the Vpp-Iac relations in the first and second image forming stations Sa, Sb are substantially equivalent with the Vpp-Iac relation in the third image forming station Sc.

After the adjustment of the variable resistor 40, the calculation of the Vpp-Iac is executed, again (S502). When the error becomes within 10%, the operation goes to the image forming operation (S508). At this time, the charging AC voltage of the charging voltage is constant-voltage-controlled to the charging AC voltage determined in the step S506.

If the discrimination in the step S501 indicates that it is not the timing of the charging bias voltage adjusting operation, the operations in the steps S502-S507 are not carried out, and the operation goes to the image forming operation with the previous settings of the charging AC voltage and the variable resistor 40 (S508).

As will be understood from the foregoing, in this embodiment, the image forming apparatus 100 includes an AC voltage source 21 for outputting the AC voltage to be applied commonly to at least two charging members. The image forming apparatus 100 includes the AC current measuring device 30 for measuring the AC current flowing into the at least two charging member when the AC voltage is applied from the AC voltage source 21. The image forming apparatus 100 includes the control means for controlling the peak-to-peak voltages of the AC voltage applied to at least two charging member from the AC voltage source 21. The image forming apparatus 100 includes variable resistors 40 connected between the AC voltage source 21 and the at least two charging members, respectively. The image forming apparatus 100 includes adjusting means for adjusting the electric resistances of the variable resistors 40, respectively. In this embodiment, the CPU 70 has functions of the control means and the adjusting means. In this embodiment, the control means carries out the following control operation. The AC voltages are applied to at least two charging members from the AC voltage source, and the AC current flowing into the respective charging members are measured by the AC current measuring devices, and then the peak-to-peak voltages of the AC voltages required to be applied from the AC voltage sources to provide the predetermined discharge currents are calculated from the result of measurements. The maximum value of the peak-to-peak voltages of the required AC voltages obtained by the calculation is determined as the target value of the constant-voltage-control during the image formation. The adjusting means adjusts the electric resistances of the variable resistors connected with the respective charging members other than the charging member for which the maximum value is calculated. When the AC voltage applied to the at least two charging members are controlled to said target value, the discharge currents within the predetermined range are flown between the photosensitive members and the charging members therefor, respectively.

In this embodiment, the discharge currents are that provided by the maximum calculated charging AC voltage among the image forming stations which are supplied from the common AC voltage source. Then, the electric resistance of the variable resistors 40 of each of the other image forming stations is adjusted toward the large side. By doing so, the Vpp-Iac of each of the other image forming stations approaches the Vpp-Iac of the image forming station with which the charging AC voltage is the maximum. Therefore, despite the employment of the common AC voltage source, the discharge currents of the image forming stations can be adjusted to be within the predetermined tolerance, that is, 10% tolerance in this embodiment. In this embodiment, the discharge currents can be adjusted to be within 100±10 μA, the predetermined discharge current being 100 μA. By doing so, the image defect attributable to the improper charging of the photosensitive drum 1 such as the sandpaper like background and/or foggy background in the other (non-maximum) ones of the image forming stations having the common AC voltage source can be alleviated.

In this embodiment, the approximated lines are determined from the data of the charging AC voltages and the charging AC currents in the discharge range and the un-discharging range, respectively. However, as will be readily understood by one skilled in the art, the approximated line can be determined from at least two points in the discharge range. In the un-discharging range, the approximated line can be determined from the zero point and at least one point (Yβ=βXβ in such a case).

As described in the foregoing according to this embodiment, the discharge current control is effected, and the variable resistors are adjusted. By this, using one AC voltage source for applying the charging AC voltages to the charging members of the image forming stations, the proper charging AC voltages for the required discharge currents can be provided without improper charging leading to the sandpaper like background, in the inexpensive and small size structure.

(Others)

The present invention is not limited to the foregoing embodiments.

In the above-described embodiments, the AC voltage source for applying the charging AC voltage in the charging member is common for the yellow, magenta and cyan image forming stations. However, this is not inevitable, and the present invention is applicable when a single AC voltage source is employed to apply the AC voltages to the charging members of the image forming stations, with the same advantageous effects. For example, the AC voltage source may be common to the yellow, magenta, cyan and black image forming stations.

To above-described embodiments, the electric resistance of the variable resistor can be adjustable in 5 positions. The number can be increased to reduce the tolerance to the required discharge current. By increasing the adjustment range of the variable resistor, the required discharge current can be provided even when the photosensitive drum is worn further.

In the above-described embodiments, the factor representing the use situation of the photosensitive drum of each image forming station is the cumulative number of image formations, the cumulative number of rotations of the photosensitive drum or the cumulative charging time of the photosensitive drum. However, this is not inevitable, and they may be used in combination. By doing so, the detection accuracy of the use situation of the photosensitive drum can be improved.

In the above-described embodiments, the calculation and determination program is executed for determining the peak-to-peak voltage or the AC current of the charging AC voltage in the charging step of the printing step, during the printing preparation rotating operation period which is a non-image-formation period. The program may be executed in another non-image-formation period, that is, during the initial rotating operation, the sheet interval step, or during the post-rotation step, or during a plurality of non-image-formation periods.

In the above-described embodiments, the image forming apparatus uses the drum cleaning device. However, the present invention is applicable to a so-called cleanerless image forming apparatus in which a developing device carries out simultaneous development and cleaning without use of a drum cleaning device.

The photosensitive drum may be a direct injection chargeable type having a charge injection layer having a surface resistance of 10^9-10^14 Ωcm. Even if the charge injection layer is not used, the present invention is applicable when the charge transfer layer has the resistance within the above-described resistance range. In addition, the photosensitive drum may be an amorphous silicon photosensitive member having a volume resistivity of the surface layer of approx. 10^13Ω.

In the above-described embodiments, the charging member is a roller type flexible contact charging member (charging roller). However, another material such as fur brush, felt or textile, or another configuration is usable. By combining various materials, proper elasticity, electroconductivity, surface property and durability can be provided.

The waveform of the AC voltage component (voltage component having periodically changing level) of the oscillating electric field applied to the charging member may be a sinusoidal wave, a rectangular wave, a triangular wave or the like. It may be a rectangular wave provided by rendering a DC voltage source ON and OFF periodically.

In the above-described embodiments, the image forming apparatus is an intermediary transfer type, but this is not inevitable in the present invention. In one type of the tandem type image forming apparatuses, a recording material carrying member is provided in place of the intermediary transfer member used in the image forming apparatus of the above-described embodiments, in which a toner image is transferred directly onto the recording material carried on recording material carrying member (direct transfer type). The recording material carrying member may be an endless belt. For example, in the full-color image forming operation, multicolor toner images are superimposedly transferred onto the recording material carried on recording material carrying member. Thereafter, the toner image on recording material is fixed on the recording material to provide a color image. The present invention is applicable to such a direct transfer type image forming apparatus, with the same advantageous effects.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 197708/2011 filed Sep. 9, 2011, which is hereby incorporated herein by reference.

What is claimed is:

1. An image forming apparatus comprising:

a plurality of photosensitive members;

a plurality of charging members, provided for said photosensitive members, respectively, for electrically charging said photosensitive members by being supplied with charging voltages each comprising a component of a DC voltage and a component of an AC voltage;

an AC voltage source for outputting an AC voltage commonly applied to at least two of said charging members;

control means for controlling the AC voltages applied to said at least two charging members;

variable resistors connected between said AC voltage source and said at least two charging members, respectively;

use situation detecting means for detecting use situations of said photosensitive members, respectively; and adjusting means for adjusting electric resistances of said variable resistors, respectively, wherein said adjusting means adjusts the electric resistances of said variable resistors in accordance with detection results of said use situation detecting means such that discharge currents flowing between said at least two charging members and said photosensitive members charged by said at least two charging members are within predetermined ranges, respectively.

2. An apparatus according to claim 1, wherein said adjusting means adjust the resistances on the basis of the AC voltage to be applied when said photosensitive members are fresh.

3. An apparatus according to claim 1, wherein the use situation is a cumulative number of image formations using the associated photosensitive member, a cumulative number of rotations of the associated photosensitive member and/or a cumulative charging duration of the associated photosensitive member, and wherein said apparatus further comprises counting means for counting the number of image formations, the number of rotations of the associated photosensitive member and/or the charging duration of the associated photosensitive member.

4. An image forming apparatus comprising:

a plurality of photosensitive members;

a plurality of charging members, provided for said photosensitive members, respectively, for electrically charging said photosensitive members by being supplied with charging voltages each comprising a component of a DC voltage and a component of an AC voltage;

an AC voltage source for outputting an AC voltage commonly applied to at least two of said charging members;

control means for controlling the AC voltages applied to said at least two charging members;

variable resistors connected between said AC voltage source and said at least two charging members, respectively;

DC current measuring devices for measuring DC currents flowing into said at least two charging members, respectively, when said photosensitive members are charged; and adjusting means for adjusting electric resistances of said variable resistors, respectively, wherein said adjusting means adjusts the electric resistances of said variable resistors in accordance with results of measurements of said DC current measuring devices during non-image forming periods such that discharge currents flowing between said at least two charging members and said photosensitive members charged by said at least two charging members are within predetermined ranges, respectively.

5. An image forming apparatus comprising:

a plurality of photosensitive members;

a plurality of charging members, provided for said photosensitive members, for electrically charging said photosensitive members by being supplied with charging voltages each comprising a component of a DC voltage and a component of an AC voltage;

an AC voltage source for outputting an AC voltage commonly applied to at least two of said charging members;

AC current measuring devices for measuring AC currents flowing into said at least two charging members, respectively;

control means for controlling peak-to-peak voltages of the AC voltages applied to said at least two charging members from said AC voltage source;

variable resistors connected between said AC voltage source and said at least two charging members, respectively; and adjusting means for adjusting electric resistances of said variable resistors, respectively, wherein said control means calculates peak-to-peak voltages of the AC voltages required to provide a predetermined discharge current, on the basis of results of measurements of said AC current measuring devices, and determines a maximum value of the required peak-to-peak voltages as a target value, and wherein said adjusting means adjusts the electric resistances of said variable resistors in accordance with results of the calculation and on the basis of the target value such that discharge currents applied to said at least two charging members are within predetermined ranges, respectively.

6. An image forming apparatus comprising:

a rotatable first photosensitive member;

a first charging member for charging said first photosensitive member;

a first toner image forming portion for forming a first toner image on said first photosensitive member charged by said first charging member;

a first transfer portion for transferring, onto a transfer medium, the first toner image formed on said first photosensitive member by said first toner image forming portion;

a first cleaning member for cleaning said first photosensitive member in contact therewith at a position downstream of said first transfer portion and upstream of said first charging member with respect to a rotational moving direction of said first photosensitive member;

a rotatable second photosensitive member;

a second charging member for charging said second photosensitive member;

a second toner image forming portion for forming a second toner image on said second photosensitive member charged by said second charging member;

a second transfer portion for transferring, onto the transfer medium, the second toner image formed on said second photosensitive member by said second toner image forming portion;

a second cleaning member for cleaning said second photosensitive member in contact therewith at a position downstream of said second transfer portion and upstream of said second charging member with respect to a rotational moving direction of said second photosensitive member;

a common AC voltage source for outputting an AC voltage applied to said first charging member and said second charging member;

a first variable resistor electrically connected between said first charging member and an output of said AC voltage source;

a second variable resistor electrically connected between said second charging member and the output of said AC voltage source;

detecting means for detecting a number of image formations on said first photosensitive member and said second photosensitive member, respectively; and adjusting means for adjusting electric resistances of said first variable resistor and said second variable resistor on the basis of detection results of said detecting means, wherein said adjusting means adjusts the electric resistances of said first variable resistor and said second variable resistor so that discharge currents flowing between said first charging member and said first photosensitive member and between said second charging member and said second photosensitive member are within predetermined ranges when said first charging member and said second charging member charge said first photosensitive member and said second photosensitive member to form the first and second toner images.

7. An image forming apparatus comprising:

a rotatable first photosensitive member;

a first charging member for charging said first photosensitive member;

a first toner image forming portion for forming a first toner image on said first photosensitive member charged by said first charging member;

a first transfer portion for transferring, onto a transfer medium, the first toner image formed on said first photosensitive member by said first toner image forming portion;

a first cleaning member for cleaning said first photosensitive member in contact therewith at a position downstream of said first transfer portion and upstream of said first charging member with respect to a rotational moving direction of said first photosensitive member;

a rotatable second photosensitive member;

a second charging member for charging said second photosensitive member;

a second toner image forming portion for forming a second toner image on said second photosensitive member charged by said second charging member;

a second transfer portion for transferring, onto the transfer medium, the second toner image formed on said second photosensitive member by said second toner image forming portion;

a second cleaning member for cleaning said second photosensitive member in contact therewith at a position downstream of said second transfer portion and upstream of said second charging member with respect to a rotational moving direction of said second photosensitive member;

a common AC voltage source for outputting an AC voltage applied to said first charging member and said second charging member;

a first variable resistor electrically connected between said first charging member and an output of said AC voltage source;

a second variable resistor electrically connected between said second charging member and the output of said AC voltage source;

detecting means for detecting numbers of rotations of said first photosensitive member and said second photosensitive member; and adjusting means for adjusting electric resistances of said first variable resistor and said second variable resistor on the basis of detection results of said detecting means, wherein said adjusting means adjusts the electric resistances of said first variable resistor and said second variable resistor so that discharge currents flowing between said first charging member and said first photosensitive member and between said second charging member and said second photosensitive member are within predetermined ranges when said first charging member and said second charging member charge said first photosensitive member and said second photosensitive member to form the first and second toner images.

8. An image forming apparatus comprising:

a rotatable first photosensitive member;

a first charging member for charging said first photosensitive member;

a first toner image forming portion for forming a first toner image on said first photosensitive member charged by said first charging member;

a first transfer portion for transferring, onto a transfer medium, the first toner image formed on said first photosensitive member by said first toner image forming portion;

a first cleaning member for cleaning said first photosensitive member in contact therewith at a position downstream of said first transfer portion and upstream of said first charging member with respect to a rotational moving direction of said first photosensitive member;

a rotatable second photosensitive member;

a second charging member for charging said second photosensitive member;

a second toner image forming portion for forming a second toner image on said second photosensitive member charged by said second charging member;

a second transfer portion for transferring, onto the transfer medium, the second toner image formed on said second photosensitive member by said second toner image forming portion;

a second cleaning member for cleaning said second photosensitive member in contact therewith at a position downstream of said second transfer portion and upstream of said second charging member with respect to a rotational moving direction of said second photosensitive member;

a common AC voltage source for outputting an AC voltage applied to said first charging member and said second charging member;

a first variable resistor electrically connected between said first charging member and an output of said AC voltage source;

a second variable resistor electrically connected between said second charging member and the output of said AC voltage source;

detecting means for detecting charging periods of said first photosensitive member and said second photosensitive member by said first charging member and said second charging member, respectively; and adjusting means for adjusting electric resistances of said first variable resistor and said second variable resistor on the basis of detection results of said detecting means, wherein said adjusting means adjusts the electric resistances of said first variable resistor and said second variable resistor so that discharge currents flowing between said first charging member and said first photosensitive member and between said second charging member and said second photosensitive member are within predetermined ranges when said first charging member and said second charging member charge said first photosensitive member and said second photosensitive member to form the first and second toner images.

9. An image forming apparatus comprising:

a rotatable first photosensitive member;

a first charging member for being supplied with a charging voltage comprising a DC voltage component and an AC voltage component and for charging said first photosensitive member;

a first toner image forming portion for forming a first toner image on said first photosensitive member charged by said first charging member;

a first transfer portion for transferring, onto a transfer medium, the first toner image formed on said first photosensitive member by said first toner image forming portion;

a first cleaning member for cleaning said first photosensitive member in contact therewith at a position downstream of said first transfer portion and upstream of said first charging member with respect to a rotational moving direction of said first photosensitive member;

a rotatable second photosensitive member;

a second charging member for being supplied with a charging voltage comprising a DC voltage component and an AC voltage component and for charging said second photosensitive member;

a second toner image forming portion for forming a second toner image on said second photosensitive member charged by said second charging member;

a second transfer portion for transferring, onto the transfer medium, the second toner image formed on said second photosensitive member by said second toner image forming portion;

a second cleaning member for cleaning said second photosensitive member in contact therewith at a position downstream of said second transfer portion and upstream of said second charging member with respect to a rotational moving direction of said second photosensitive member;

a DC voltage source for applying a DC voltage to said first charging member and said second charging member;

a common AC voltage source for outputting an AC voltage applied to said first charging member and said second charging member;

a first variable resistor electrically connected between said first charging member and an output of said AC voltage source;

a second variable resistor electrically connected between said second charging member and the output of said AC voltage source;

a DC current measuring device for measuring DC currents flowing through said first charging member and said second charging member when said first photosensitive member and said second photosensitive member are charged; and adjusting means for adjusting electric resistances of said first variable resistor and said second variable resistor on the basis of a result of measurement of said DC current measuring device, wherein said adjusting means adjusts the electric resistances of said first variable resistor and said second variable resistor so that discharge currents flowing between said first charging member and said first photosensitive member and between said second charging member and said second photosensitive member are within predetermined ranges when said first charging member and said second charging member charge said first photosensitive member and said second photosensitive member to form the first and second toner images.

10. An image forming apparatus comprising:

a rotatable first photosensitive member;

a first charging member for charging said first photosensitive member;

a first toner image forming portion for forming a first toner image on said first photosensitive member charged by said first charging member;

a first transfer portion for transferring, onto a transfer medium, the first toner image formed on said first photosensitive member by said first toner image forming portion;

a first cleaning member for cleaning said first photosensitive member in contact therewith at a position downstream of said first transfer portion and upstream of said first charging member with respect to a rotational moving direction of said first photosensitive member;

a rotatable second photosensitive member;

a second charging member for charging said second photosensitive member;

a second toner image forming portion for forming a second toner image on said second photosensitive member charged by said second charging member;

a second transfer portion for transferring, onto the transfer medium, the second toner image formed on said second photosensitive member by said second toner image forming portion;

a second cleaning member for cleaning said second photosensitive member in contact therewith at a position downstream of said second transfer portion and upstream of said second charging member with respect to a rotational moving direction of said second photosensitive member;

a common AC voltage source for outputting an AC voltage applied to said first charging member and said second charging member;

an AC current measuring device for measuring AC currents flowing through said first charging member and said second charging member by application of the AC voltages from said AC voltage source;

controlling means for controlling peak-to-peak voltages of the AC voltages applied to said first charging member and said second charging member from said AC voltage source;

a first variable resistor electrically connected between said first charging member and an output of said AC voltage source;

a second variable resistor electrically connected between said second charging member and the output of said AC voltage source; and adjusting means for adjusting electric resistances of said first variable resistor and said second variable resistor, wherein said controlling means calculates peak-to-peak voltages of the AC voltage required to provide predetermined discharge currents flowing between said first charging member and said first photosensitive member and between said second charging member and said second photosensitive member on the basis of results of the measurements by said AC current measuring device while applying the AC voltages to said first charging member and said second charging member from said AC voltage source, and sets a larger one of the calculated peak-to-peak voltages as the peak-to-peak voltages of the AC voltages to be outputted from said AC voltage source when said first photosensitive member and said second photosensitive member are charged by said first charging member and said second charging member to form the first and second toner images, and said adjusting means adjusts the electric resistances of said first variable resistor and said second variable resistor so that discharge currents flowing between said first charging member and said first photosensitive member and between said second charging member and said second photosensitive member are within predetermined ranges when said first charging member and said second charging member charge said first photosensitive member and said second photosensitive member to form the first and second toner images.

* * * * *